US008989616B2

(12) United States Patent
Yasumoto

(10) Patent No.: US 8,989,616 B2
(45) Date of Patent: Mar. 24, 2015

(54) IMAGE FORMING APPARATUS

(71) Applicant: Canon Kabushiki Kaisha, Tokyo (JP)

(72) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 62 days.

(21) Appl. No.: 13/839,944

(22) Filed: Mar. 15, 2013

(65) Prior Publication Data

US 2013/0223860 A1 Aug. 29, 2013

Related U.S. Application Data

(62) Division of application No. 12/847,060, filed on Jul. 30, 2010, now Pat. No. 8,428,487.

(30) Foreign Application Priority Data

Jul. 31, 2009 (JP) ..... 2009-179913

(51) Int. Cl.
*G03G 21/20* (2006.01)
*G03G 15/00* (2006.01)

(52) U.S. Cl.
CPC ..... *G03G 21/206* (2013.01); *G03G 15/50* (2013.01)
USPC ..... 399/94

(58) Field of Classification Search
USPC ..... 399/44, 53, 66, 67, 69, 91, 94, 97, 98, 399/302, 303, 308
See application file for complete search history.

(56) References Cited

U.S. PATENT DOCUMENTS

| | | | | |
|---|---|---|---|---|
| 7,039,331 | B2 | 5/2006 | Yoshida | |
| 7,269,374 | B2 | 9/2007 | Oka | |
| 7,664,444 | B2 | 2/2010 | Mochizuki | |
| 7,873,297 | B2 * | 1/2011 | Andoh et al. | 399/94 |
| 8,417,142 | B2 * | 4/2013 | Furuichi et al. | 399/94 |
| 2006/0051124 | A1 | 3/2006 | Oka | |
| 2008/0095556 | A1 | 4/2008 | Mochizuki | |

FOREIGN PATENT DOCUMENTS

| | | | |
|---|---|---|---|
| JP | 2002-132121 | A | 5/2002 |
| JP | 2003-5614 | A | 1/2003 |
| JP | 2006-78683 | A | 3/2006 |
| JP | 2006-276252 | A | 10/2006 |
| JP | 2008-107506 | A | 5/2008 |

* cited by examiner

*Primary Examiner* — Hoan Tran
(74) *Attorney, Agent, or Firm* — Fitzpatrick, Cella, Harper & Scinto

(57) ABSTRACT

An image forming apparatus includes first and second image bearing drums; first and second developing devices for forming a toner image on the drums; an intermediary transfer member for carrying images transferred front the drums and secondary transferring the toner image onto a recording material; a heater for heating the recording material; an executing portion for executing a first mode for forming a toner image on the intermediary transfer member from both drums and a second mode for forming a toner image on the intermediary transfer member only from the second drum; a temperature detecting portion; a fan; a controller for controlling the fan based on a detected temperature; a setting portion for setting a temperature at which an air feed amount of the fan is increased in the second mode is lower than a temperature at which the all feed amount is increased in the first mode.

10 Claims, 14 Drawing Sheets

(a) FULL COLOR (b) BLACK (a) FULL CLR (b) BLK

IMAGE FORMING APPARATUS

This application is a divisional of U.S. patent application Ser. No. 12/847,060, filed Jul. 30, 2010, which issued as U.S. Pat. No. 8,428,487 on Apr. 23, 2013.

FIELD OF THE INVENTION AND RELATED ART

The present invention relates to an image forming apparatus which has multiple image forming portions which are selectively usable to form images. More specifically, it relates to the method for controlling an image forming apparatus in the ventilation of its internal air to prevent toner particles from adhering to the cleaning apparatus which is for cleaning the intermediary transferring member of the apparatus.

Recently, full-color image forming apparatuses of the tandem type have come to be widely used. A typical full-color image forming apparatus of the tandem type has: multiple image forming portions which are different in the color of the monochromatic image they form; and an intermediary transfer belt along which the multiple image forming portions are sequentially disposed in parallel. However, full-color image forming apparatuses are frequently used for outputting black-and-white images. Therefore, full-color image forming apparatuses are designed so that they can be operated in the black-and-white mode, in which black monochromatic images are outputted activating only the image forming portion for forming black monochromatic images (image forming portions for forming monochromatic color images are kept inactivated).

Japanese Laid-open Patent Application 2008-107506 discloses an image forming apparatus provided with a mechanism for making it possible to keep its intermediary transfer belt separated from its photosensitive drums for forming monochromatic color images. When this image forming apparatus is used in the black-and-white mode, its intermediary transfer belt is kept separated from these photosensitive drums for the formation of monochromatic color images, in order to prevent them from being frictionally worn.

The toners which have come to be widely used in recent years are likely to be lower in melting point than the toners which were used in the past. The lower in melting point the toner used for an image forming operation, the lower in temperature the developing apparatus, drum cleaning apparatus, and intermediary transfer belt cleaning apparatus, which stir toner one way or the other, have to be kept, because the higher the temperature of these apparatuses, the more likely for toner to adhere to their conveyance screws, internal walls, etc.

Japanese Laid-open Patent Application 2002-132121 discloses an image forming apparatus, the developing apparatus and drum cleaning apparatus of which are individually provided with a cooling apparatus which uses air as cooling medium, so that they can be individually controlled in temperature with their own cooling apparatus.

Japanese Laid-open Patent Application 2003-5614 discloses an image forming apparatus, the temperature of which is measured at a preset location in its housing, and which is controlled in the amount by which air is exhausted from the housing, based on the measured internal temperature of the housing. More specifically, this image forming apparatus is provided with an exhaust fan which can be varied in air volume, and a temperature sensor. As the internal temperature of the apparatus detected by the temperature sensor reaches a preset level, the exhaust fan is increased in output (amount by which air is exhausted from housing) from the first amount to the second amount.

Referring to FIG. 1, an image forming apparatus of the tandem type, which uses an intermediary transfer member, is large in the number of components which stir toner, that is, the components which need to be cool. Thus, it is not practical to provide each of these components with an air-based cooling apparatus as disclosed in Japanese Laid-open Patent application 2002-132121. Thus, it was proposed to provide an image forming apparatus of the tandem type, which uses an intermediary transfer member, with an air-based cooling apparatus which can be changed in steps in the amount by which it can blow air, so that the multiple components of the apparatus, which need to be cooled, can be cooled together by a proper amount of air.

However, an image forming apparatus of the tandem type, which uses an intermediary transfer member, has various components which have to be individually replaced. Thus, it is not practical to solidly attach a temperature sensor to each component which needs to be controlled in temperature. Thus, it was proposed to place a temperature sensor for detecting a representative internal temperature of the housing of the apparatus, and increase in steps the air blowing fan in output as the temperature detected by the temperature sensor reaches each of the preset levels.

Referring to FIG. 6, in the case of the setup described above, however, the temperature (Ts) of the location in the housing of the apparatus, the temperature of which represents the internal temperature of the housing, and is detected by the temperature sensor, does not accurately reflect the temperature (41) of the cleaning apparatus for cleaning the intermediary transfer member. As a solution to this problem, it is possible to set to a high value the amount by which air is blown into the housing, to ensure that the components which need to be cooled are properly cooled. However, if the amount by which air is blown into the housing of the apparatus is set higher for a greater margin of safety, the apparatus increases in operational noises and electric power consumption, which negates the idea of providing the apparatus with a temperature sensor to switch the exhaust fan of the apparatus in air volume, based on the temperature detected by the sensor.

This setup has also the following problem. That is, assuming, that a temperature sensor (10) for detecting the representative internal temperature of the housing of the image forming apparatus is placed as shown in FIG. 1, if a developing apparatus 9M, that is, one of the developing apparatuses for developing an electrostatic latent image into a monochromatic color image, is kept inactive in the black-and-white mode, the temperature sensor (10) positioned in the housing of the apparatus to catch the heat from the developing apparatus 9M, remains lower in output value than in the full-color mode. Thus, the cleaning apparatus (14) for cleaning the intermediary transfer member, which catches the same amount of heat from the fixing apparatus (15) as when the image forming apparatus is in the full-color mode, excessively increases in temperature (41) before the output of the temperature sensor (10) reaches a preset level (Ts)c.

SUMMARY OF THE INVENTION

The primary object of the present invention is to provide an image forming apparatus whose cleaning apparatus for cleaning the intermediary transfer member of the image forming apparatus does not excessively increase in temperature even when the image forming apparatus is in the black-and-white mode.

According to a first aspect of the present invention, there is provided an image forming apparatus comprising a first image bearing member; a first developing device for forming a toner image on said first image bearing member; a second image bearing member; a second developing device for forming a toner image on said second image bearing member; an intermediary transfer member capable of carrying the toner image transferred from said first image bearing member and the toner image transferred from said second image bearing member; a cleaning device for collecting toner deposited on said intermediary transfer member; heating means for heating at least a recording material; an executing portion capable executing an operation in a first image forming mode for forming the toner image on said intermediary transfer member from said first and second image bearing members and an operation in a second image forming mode for forming a toner image on an intermediary transfer member from said second image bearing member without transfer of the toner image from said first image bearing member onto said intermediary transfer member; a temperature detecting portion disposed in said image forming apparatus; a fan for feeding air in said image forming apparatus; control means for controlling said fan on the basis of an output of said temperature detecting portion so that an air feed amount increases with increase of the temperature indicated by the output; and a setting portion for setting a temperature so that the temperature at which the air feed amount is increased in the second image forming mode is lower than the temperature at which the air feed amount is increased in the first image forming mode.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings. The embodiments of the present invention, which will be described next, are not intended to limit the present invention in scope. That is, the present invention is also applicable to any image forming apparatus which is different in structure from the image forming apparatuses in the following embodiments of the present invention in that its structural features are partially or entirely replaced with equivalent structural features, as long as it is characterized in that the timing with which its exhaust fan increases in the number of revolutions in response to the increase in the internal temperature of the housing of the apparatus when the apparatus is in the black-and-white mode is earlier than that in the full-color mode.

In the following description of the preferred embodiments of the present invention, only the portions of the apparatus, which are directly related to the formation and transfer of toner images, are described. However, the present invention is applicable also to various image forming apparatuses, such as printers, copying machines, facsimile machines, multifunction image forming apparatuses, etc., which are made up of the portions which will be described next, and additional devices, equipment, housing, etc.

<Image Forming Apparatus>

Figure 1:
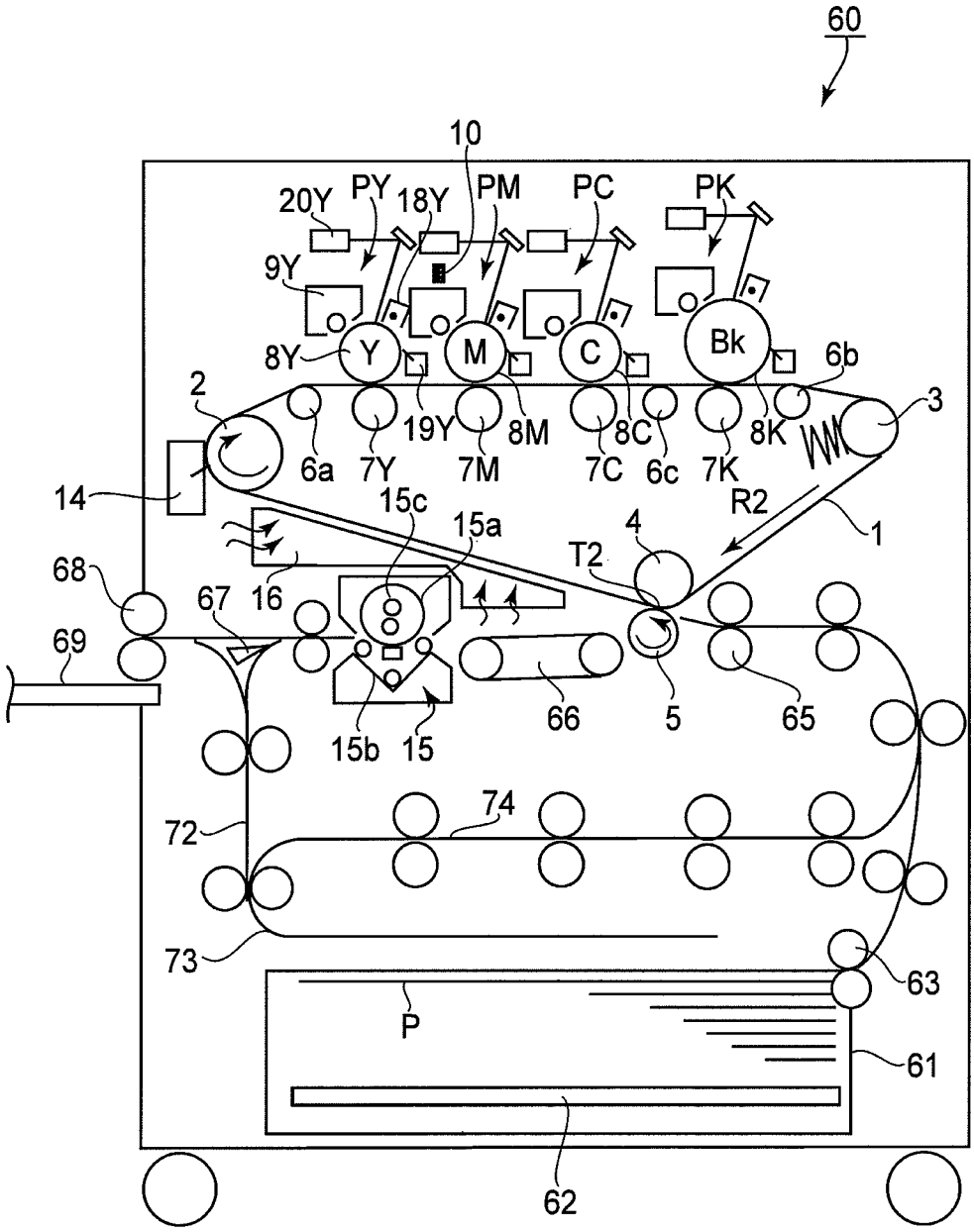
FIG. 1 is a schematic sectional view of a typical full-color image forming apparatus which uses an intermediary transfer member, and depicts the structure of the apparatus.
Figure 2:
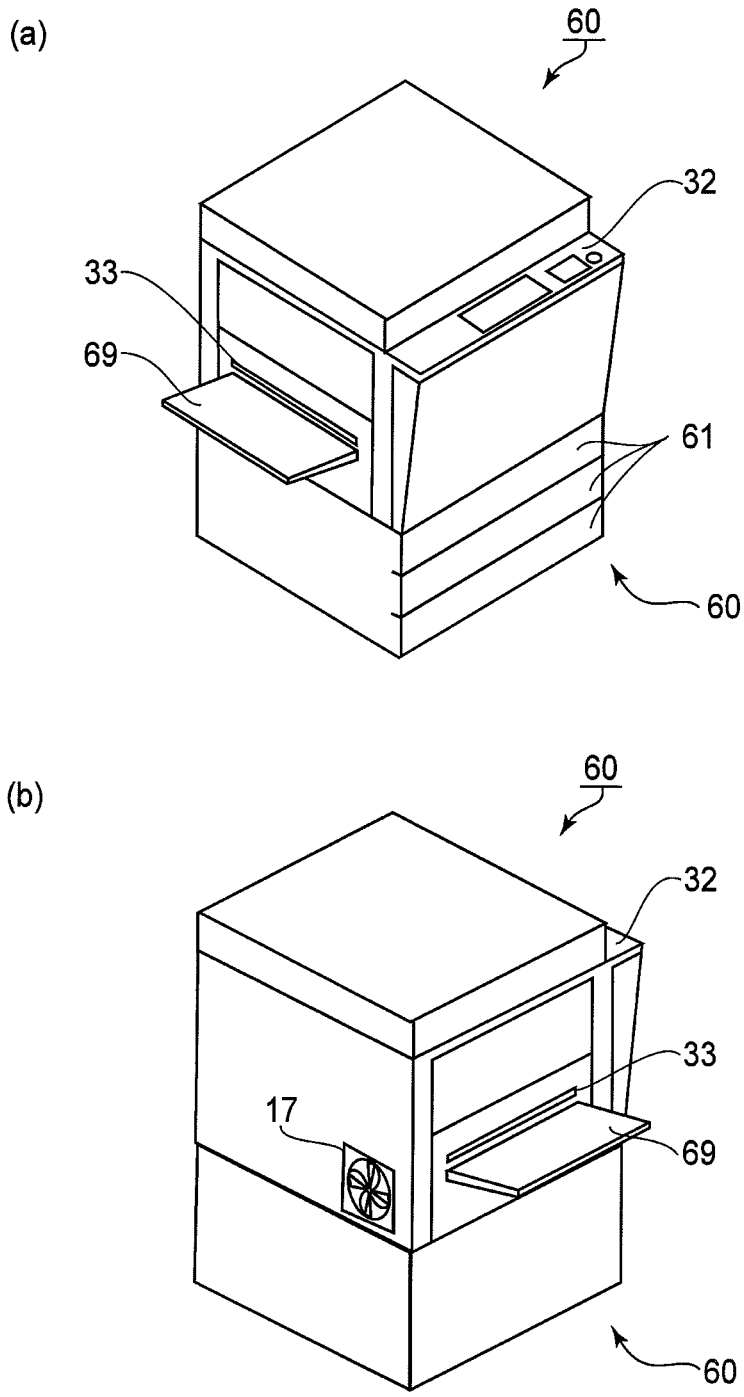
FIGS. 2(*a*) and 2(*b*) are perspective external views of the image forming apparatus.

FIG. 1 is a schematic sectional view of a typical full-color image forming apparatus which uses an intermediary transfer member, and depicts the structure of the apparatus. FIGS. 2(*a*) and 2(*b*) are perspective external views of the image forming apparatus.

Referring to FIG. 1, an image forming apparatus 60 is a full-color printer of the tandem type, which uses an intermediary transfer member. More specifically, it has: an intermediary transfer belt 1 (intermediary transfer member); and image forming portions PY, PM, PC, and PK, which are sequentially disposed in parallel along the intermediary transfer belt 1. Image forming apparatuses of the tandem type, which use an intermediary transfer member, are excellent in terms of productivity and compatibility with various recording media. Therefore, they have become one of the mainstream image forming apparatuses in recent years.

In the image forming portion PY, a yellow toner image is formed on a photosensitive drum 8Y (image bearing member), and is transferred (primary transfer) onto the intermediary transfer belt 1. In an image forming portion PM, a magenta toner image is formed on a photosensitive drum 8M, and is transferred (primary transfer) onto the intermediary transfer belt 1 in a manner of being layered on the yellow toner image on the intermediary transfer belt 1. In image forming portions PC and PK, a cyan toner image and a black toner image are formed on photosensitive drums 8C and 8K, respectively, and are sequentially transferred (primary transfer) onto the intermediary transfer belt 1 in a manner of being layered upon the yellow and magenta toner images on the intermediary transfer belt 1.

After the transfer (primary transfer) of the four monochromatic toner images, different in color, onto the intermediary transfer belt 1, the four toner images are conveyed by the transfer belt 1 to a secondary transfer portion T2, in which they are transferred all at once (secondary transfer) onto a sheet of recording medium P. More specifically, the sheet of recording medium P is fed into the main assembly of the image forming apparatus 60 from a recording medium cassette 61 in which multiple sheets of recording medium P are stored in layers, while being separated from the rest. Then, the recording medium P is kept on standby by a pair of registration roller 65. Then, the sheet of recording medium P is sent to the secondary transfer portion T2 by the pair of registration rollers 65 with such timing that the recording medium P arrives at the secondary transfer portion T2 at the same time as the layered toner images on the intermediary transfer belt 1 arrive at the secondary transfer portion T2.

After the transfer (secondary transfer) of the layered toner images onto the recording medium P, the recording medium P is conveyed to a fixing apparatus 15 by a recording medium conveying portion 66 which is on the immediately upstream side of the fixing apparatus 15. In the fixing apparatus 15, the recording medium P and the toner images thereon are subjected to heat and pressure, whereby the toner images become fixed to the surface of the recording medium P. Then, the recording medium P is discharged into a delivery tray 69 by a pair of discharge rollers 68.

When the image forming apparatus 60 is in the two-sided print mode, the recording medium P is guided downward by a flapper 67 after the fixation of the images to the recording medium P by the fixing apparatus 15. Then, it is turned over with the use of a switchback path 73. Then, the recording medium P is sent through a two-sided print mode path 74 to the registration rollers 65, where it is kept on standby. Then, the next set of toner images is transferred onto the second surface (back surface) of the recording medium P, and fixed to the second surface, through the same steps as those involved in the transfer of the first set of toner images onto the first surface (front surface). Then, the recording medium P is discharged into the delivery tray 69.

The image forming portions PY, PM, PC, and PK are virtually the same in structure, although they are different in the color of the toners (yellow, magenta, cyan, and black, respectively) which their developing apparatus use in the image forming portions PY, PM, PC, and PK, respectively. Thus, only the yellow image forming portion PY will be described. As for the description of the other image forming portions PM, PC, and PK, it will suffice to replace the last letter (Y) of the referential codes for the structural components of the image forming portion PY, with M, C, and K, respectively.

The image forming portion PY has the photosensitive drum 8Y. It has also a charge device 18Y of the corona type, an exposing apparatus 20Y, a developing apparatus 9Y, a primary transfer roller 7Y, and a cleaning apparatus 19Y, which are disposed in the adjacencies of the peripheral surface of the photosensitive drum 8Y in a manner to surround the photosensitive drum 8Y. The photosensitive drum BY is made up of a piece of metallic cylinder, and a photosensitive layer formed on the peripheral surface of the metallic cylinder. The photosensitive layer is negative in the polarity to which it is charged. The photosensitive drum 8Y is rotated at a preset process speed in the direction indicated by an arrow mark.

The charging device 18Y of the corona type uniformly and negatively charges the peripheral surface of the photosensitive drum 8Y to a preset potential level. The exposing apparatus 20Y writes an electrostatic latent image of the image to be formed, on the uniformly charged portion of the peripheral surface of the photosensitive drum 8Y. The developing apparatus 9Y negatively charges the two-component developer which it uses, by stirring the developer, and develops in reverse the electrostatic image on the photosensitive drum 8Y with the negatively charged toner.

The primary transfer roller 7Y presses on the inward surface (in terms of loop intermediary transfer belt forms) of the intermediary transfer belt 1 against the photosensitive drum 8Y, whereby it forms the toner image transferring primary portion (which hereafter will be referred to simply as primary transfer portion) between the intermediary transfer belt 1 and photosensitive drum 8Y. As a positive DC voltage is applied to the primary transfer roller 7Y, the toner image on the photosensitive drum 8Y is transferred (primary transfer) onto the intermediary transfer belt 1.

The intermediary transfer belt 1 is supported by a driver roller 2, a tension roller 3, a backup roller 4, and follower rollers 6*a*-6*c*, in a manner of being wrapped around the rollers. It circularly moves in the direction indicated by an arrow mark R2 by being driven by the driver roller 2. A secondary transfer roller 5 and the backup roller 4 are kept pressed against each other with the presence of the intermediary transfer belt 1 between them, forming thereby the secondary transfer portion T2 between the intermediary transfer belt 1 and secondary transfer roller 5. The secondary transfer portion T2 is where the toner images on the intermediary transfer belt 1 are transferred onto the recording medium P. More specifically, while a portion of the intermediary transfer belt 1, on which toner images are present, is conveyed, along with the recording medium P, through the secondary transfer portion T2, a positive DC voltage is applied to the secondary transfer roller 5, whereby the toner images on the intermediary transfer belt 1 are transferred (secondary transfer) from the intermediary transfer belt 1 onto the recording medium P. A belt cleaning apparatus 14 recovers the toner remaining adhered to the surface of the intermediary transfer belt 1, on the downstream side of the secondary transfer portion T2.

Next referring to FIG. 2(*a*), the portion of the image forming apparatus 60, which has the above-mentioned recording medium cassette 61 and a control panel, is defined as the front side, and the portion of the image forming apparatus 60, which has the delivery tray 69 is defined as the left side. The recording medium cassette 61 can be pulled out frontward of the apparatus 60. Referring to FIG. 2(*b*), the rear portion of the image forming apparatus 60 is provided with an exhaust fan 17 for ventilating the housing of the apparatus 60. Usually, the image forming apparatus 60 is provided with an external cover for the exhaust fan 17, and the cover is provided with louvers or the like. In other words, the exhaust fan 17 is not directly exposed.

<Black-and-White Mode>

Figure 3:
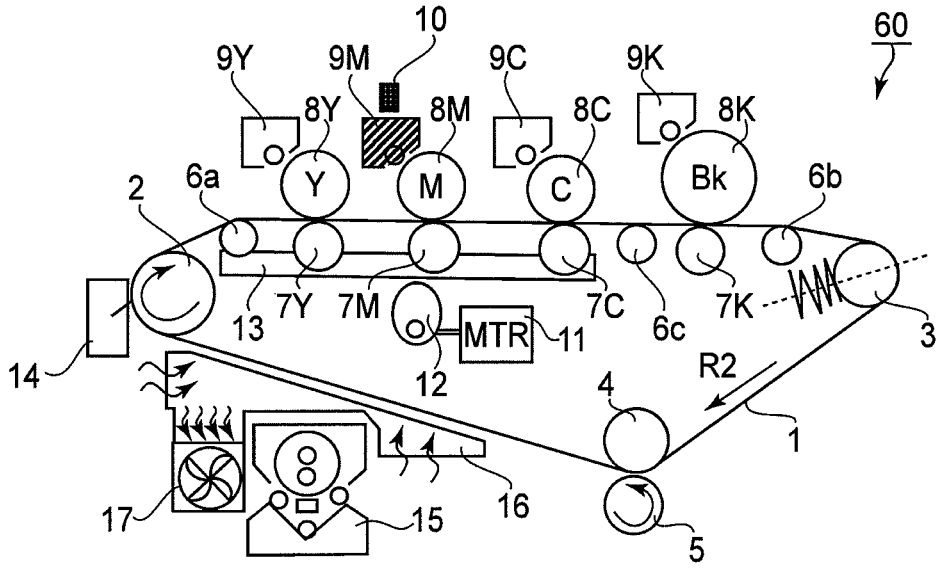
FIGS. 3(*a*) and 3(*b*) are schematic drawings of the mechanism for keeping the intermediary transferring member of the image forming apparatus separated from the photosensitive drums for forming yellow, magenta, and cyan images, one for one, of the apparatus, when the image forming apparatus is in the black-and-white mode, and depict the structure of the mechanism.
Figure 3:
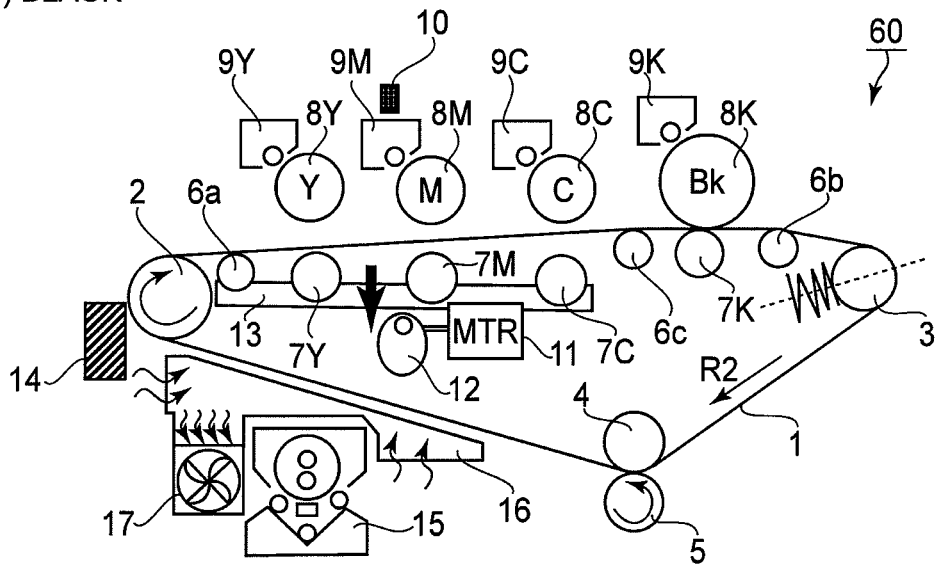

FIGS. 3(*a*) and 3(*b*) are schematic drawings of the mechanism for keeping the intermediary transferring member of the image forming apparatus 60 separated from the photosensitive drums for forming yellow, magenta, and cyan images, one for one, of the apparatus 60, when the apparatus 60 is in the black-and-white mode. They depict the structure of the mechanism. The image forming apparatus 60 can be selectively operated in the full-color mode (first mode) and the black-and-white mode (second mode). In the full-color mode, both the first photosensitive members 8Y, 8M, and 8C, and the second photosensitive member 8K, are used to form four monochromatic toner images, one for one. In the black-and-white mode, the first developing apparatuses 9Y, 9C, and 9K, which are provided to develop latent images on the first photosensitive members 8Y, 8M, and 8K, respectively, are not activated; only the secondary photosensitive member 8K, for which the second developing apparatus 9K is provided, is used to form a toner image.

Next, referring to FIG. 3(*a*), the primary transfer rollers 7Y, 7M, and 7C, and follower roller 6*a* are held by a holder 13, which comes into contact with a cam 12 which is in connection to a motor 11. If the full-color mode is selected, the holder 13 is lifted by the cam 12 into a position in which it keeps the primary transfer rollers 7Y, 7M, and 7C pressed against the photosensitive drums 8Y, 8M, and 8C, respectively. As the holder 13 is lifted, the follower roller 6*a*, along with the follower roller 6*b*, pushes up the intermediary transfer belt 1, forming thereby the primary transfer portions. In other words, the intermediary transfer belt 1 is placed in contact with all of the photosensitive drums 8Y, 8M, 8C, and 8K to form full-color images using all of the four image forming portions PY, PM, PC, and PK.

Next, referring to FIG. 3(*b*), if the black-and-white mode is selected, the holder 13 is lowered by the change in the rotational phase of the cam 12, into the position in which it prevents the primary transfer rollers 7Y, 7M, and 7C from pressing the intermediary transfer belt 1 upon the photosensitive drums 8Y, 8M, and 8C, respectively, and also, in which it prevents the follower roller 6*a* from placing the intermediary transfer belt 1 in contact with the photosensitive drums 8Y, 8M, and 8C. The role of forming the primary transfer portion is played by the follower rollers 6*b* and 6*c*.

As described above, in order to prevent the photosensitive drums 8Y, 8M, and 8C from being rotated by the movement of the intermediary transfer belt 1, the holder 13 is lowered to the position in which it does not cause the transfer rollers 7Y, 7M, and 7C to press the intermediary transfer belt 1 upon the photosensitive drums 8Y, 8M, and 8C, respectively. Further, the motor for driving the photosensitive members 8Y, 8M, and 8C, and the motor for driving the developing apparatuses 9Y, 9M, and 9C are stopped. Inactivating the three image forming portions PY, PM, and PC, which are unnecessary for the black-and-white mode, prevents the photosensitive drums 8Y-8C from being frictionally worn, and also, prevents the two-component developers in the developing apparatuses 9Y, 9M, and 9C from deteriorating.

In this embodiment, the image forming apparatus 60 is structured so that when it is in the black-and-white mode, even the photosensitive drums 8Y, 8M, and 8C are not activated at all. However, it may be structured in consideration of only the prevention of the deterioration of the two-component developers. That is, it may be structured so that it does not have the mechanism for keeping the primary transfer rollers 7Y, 7M, and 7C separated from the intermediary transfer belt 1 and only the developing apparatuses 9Y, 9M, and 9C are inactivated to prevent the two-component developers used by the developing apparatuses 9Y, 9M, and 9C from deteriorating.

<Temperature Increase of Various Portions in Housing of Image Forming Apparatus, and Cooling System>

Figure 4:
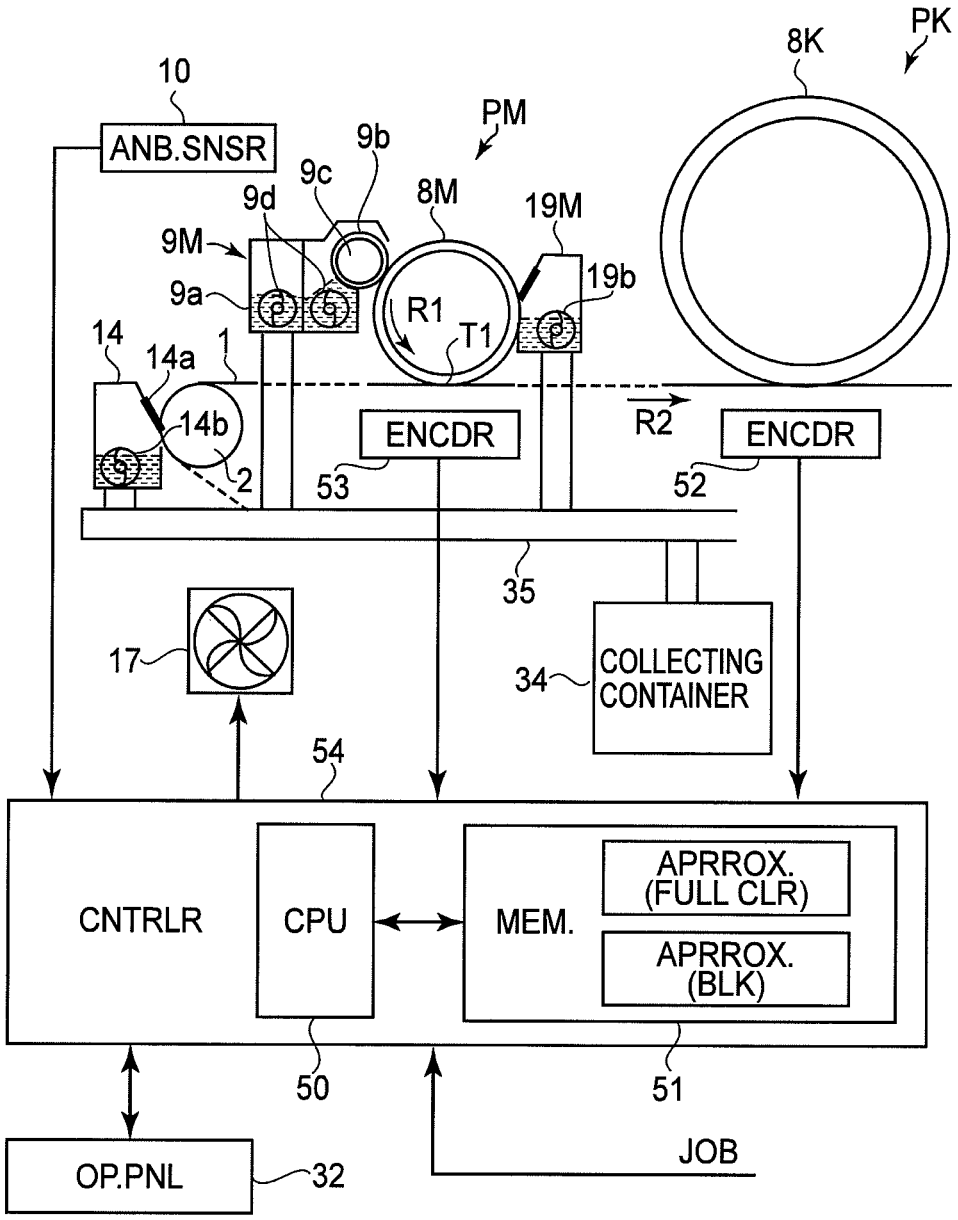
FIG. 4 is a schematic drawing for describing the toner recovery system of the image forming apparatus.
Figure 5:
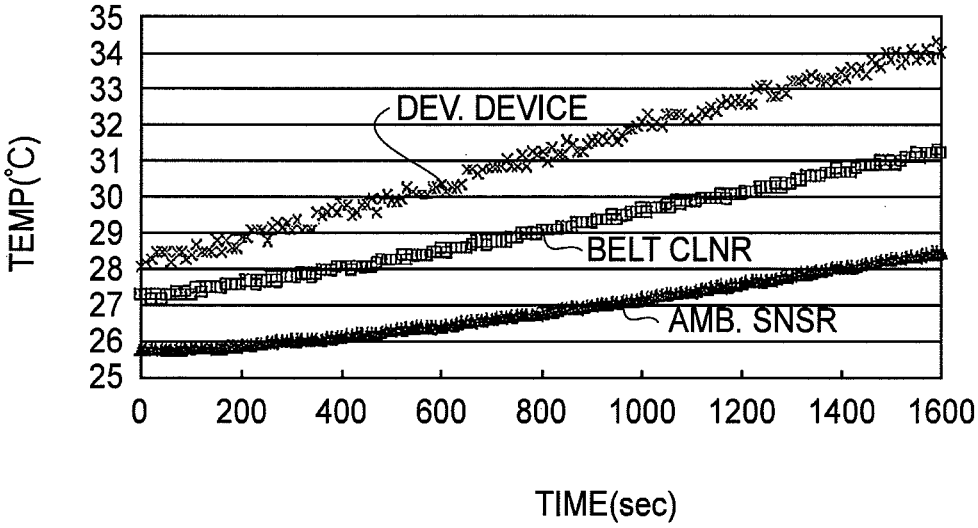
FIGS. 5(*a*) and 5(*b*) are graphs which show the temperature increase of magenta developing apparatus and belt cleaning apparatus of the image forming apparatus when the apparatus is in the full-color mode and black-and-white mode, respectively.
Figure 5:
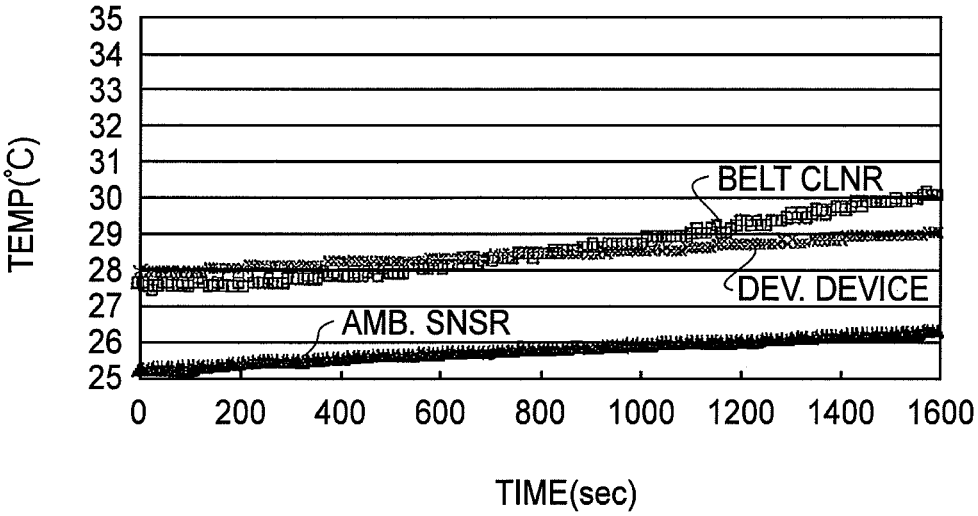

FIG. 4 is a schematic drawing for describing the toner recovery system of the image forming apparatus. FIGS. 5(*a*) and 5(*b*) are graphs which show the temperature increase of various internal portions of the image forming apparatus when the apparatus is in the full-color mode and black-and-white mode, respectively.

Referring to FIG. 4, the developing apparatus 9M has a developer container 9*a*, a development sleeve 9*b*, a magnetic roll 9*c*, and a pair of stirring screws 9*d*. It contains two-component developer. It circularly moves the two-component developer in the developer container 9*a* by conveying the developer in the direction perpendicular to the recording medium conveyance direction, with the pair of stirring screws 9*d* while stirring the developer with the stirring screws 9*d*. While the two-component developer is circularly moved in the developer container 9*a* while being stirred, the toner particles and carrier particles of the developer rub against each other, being thereby negatively and positively charged, respectively. The charged two-component developer is borne by the development sleeve 9*b* which is rotating around the magnetic roll 9*c*, which is stationary. The two-component developer carried on the development sleeve 9*b* rubs the peripheral surface of the photosensitive drum 8M.

The belt cleaning apparatus 14, which is an example of an apparatus for cleaning the intermediary transfer belt 1, has a cleaning blade 14*a*, which is positioned to be made to rub the intermediary transfer belt 1, which is an example of an intermediary transfer member, to scrape away the toner remaining on the intermediary transfer belt 1 after the secondary transfer. The residual toner recovered by scraping of the intermediary transfer belt 1 by the cleaning blade 14*a* is conveyed to the rear end portion of the apparatus 60 by a conveyance screw 14*b*, and then, is made to join with the body of toner which is being recovered into a toner recovering apparatus 35. Then, it is conveyed to a container 34 for the recovered toner, in which it is stored.

As the development sleeve 9*b*, stirring screws 9*d*, etc., rotate, the bearing portions of the developing apparatus 9M (9Y, 9M, and 9K) become hot because of the heat generated by the friction among the components such as the above-mentioned ones, the friction between the development screws 9*d* and their bearings, and the friction between the developer and screws. The belt cleaning apparatus 14 also increases in temperature because of the friction between the cleaning blade 14*a* and intermediary transfer belt 14, and the rotation of the toner conveyance screw 14*b*.

Referring to FIG. 1, the image forming apparatus 60 has the fixing apparatus 15 which fixes the unfixed toner images on the recording medium P to the recording medium P by melting the unfixed toner images. The fixing apparatus 15 has a roller 15*a* and a belt 15*b*, which form a fixation nip. It fixes the unfixed toner images on the recording medium P to the recording medium P by applying heat and pressure to the recording medium P and the unfixed toner images thereon with the roller 15*a* and belt 15*b* while the recording medium P is conveyed through the fixation nip. The fixing apparatus 15 has a heater 15*c* (as one of heat sources), which is in the hollow of the roller 15*a*. The heater 15*c* is controlled in the electric power supplied thereto so that the temperature of the fixation nip remains optimal for fixation.

The fixing apparatus 15 has a heating means such as the heater 15*c*. Therefore, it is one of the heat sources in the image forming apparatus 60. Further, when the image forming apparatus 60 is in the two-sided print mode, the recording medium P is fed back to the image forming portions through the recording medium conveyance path for the two-sided print mode. Therefore, it re-circulates the heat it rubbed from the fixing apparatus 15 back into the image forming portions.

Next, referring to FIG. 5(*a*), when the image forming apparatus 60 is in the full-color mode, the various internal portions of the image forming apparatus 60 are different in the amount of the heat they generate themselves and the amount of heat they receive from the above-mentioned heat sources. Therefore, they are different in the pattern in which they increase in temperature after the startup of the image forming apparatus 60. In comparison, referring to FIG. 5(*b*), when the image forming apparatus 60 is in the black-and-white mode, the developing apparatuses 9Y, 9M, and 9C are not activated, and therefore, they do not generate heat by themselves. Thus, when the image forming apparatus 60 is in the black-and-white mode, the pattern in which various internal portions of the image forming apparatus 60 increase in temperature is different from the pattern in which they increases in temperature when the image forming apparatus 60 is in the full-color mode.

Referring again to FIG. 1, the internal temperature of the image forming apparatus 60 gradually increases as a printing operation continues. Therefore, it is possible that toner will melt, solidify, and/or deteriorate in the developing apparatuses 9Y, 9M, and 9C, and also, the belt cleaning apparatus 14. Therefore, in order to cool these apparatuses together, the image forming apparatus 60 is provided with an air flow system which has the exhaust fan 17.

Generally speaking, there are two types of air flow in the image forming apparatus 60. One is generated as the ambient air of an apparatus is introduced into the housing of the apparatus to cool the heat generating portions in the housing. The other is generated as the hot internal air of the apparatus is exhausted to remove heat from within the housing of the apparatus. In the case of the image forming apparatus 60, an exhaust air duct 16 and the exhaust fan 17 create the latter. In order to prevent the air flow system from directly robbing heat from the fixing apparatus 15, the exhaust duct 16 is provided with openings for suctioning the ambient air of the recording medium conveying portions and image forming portions. Referring to FIG. 2(*b*), the rear wall of the housing of the image forming apparatus 60 has an opening, in which the aforementioned exhaust fan 17 is fitted. This opening is in connection to the exhaust duct 15, and functions as the outlet for the outward air flow. The housing has various openings through which the ambient air of the image forming apparatus 60 can enter the image forming apparatus 60. The sheet delivery opening 33 is one of such openings.

It has been a common practice to provide an image forming apparatus with an air flow system made up of an exhaust fan and an exhaust air duct to aggressively discharge the internal air of the housing of the apparatus as disclosed in Japanese Laid-open Patent Application 2003-5614. Generally speaking, however, increasing the air flow system in heat discharging efficiency by providing the system with an exhaust fan increases the fan in operational noise, which is a problem.

A substantial number of image forming apparatuses, in particular, copy machines, are placed in quiet offices. Therefore, the noise from their exhaust fans is problematic. Further, in recent years, it has become a trend to place a small printer on a desk. Therefore, the noise from a copy machine is a big problem. Moreover, even from the standpoint of electric power consumption, it is undesirable to aggressively use an exhaust fan.

It was recognized even in Japanese Laid-open Patent Application 2003-5614 that the prevention of the increase in the internal temperature of the housing of an image forming apparatus and the reduction in the noises generated by an image forming apparatus have to be achieved together. Thus, it has been tried to minimize an image forming apparatus in the operation of its exhaust fan. More specifically, the amount by which the photosensitive drums of an image forming apparatus increased in temperature is estimated based on the internal temperature of the apparatus detected by the an environment sensor which the apparatus has, and the exhaust fan is precisely controlled in the number of revolution and the length of time it is driven.

In recent years, as it has become a common practice to use a color image forming apparatus, consumers have begun to demand that color image forming apparatuses are increased in productivity and image quality. Thus, it has become necessary to detect the internal temperature of a developing apparatus even for controlling the developing apparatus in toner density. It also has come to be required that the environment sensor for detecting the internal temperature of a developing apparatus is enabled to detect the internal temperature of the housing of an image forming apparatus. In this case, not only is the environment sensor of an image forming apparatus required to roughly grasp the conditions (high in temperature and humidity, low in temperature and humidity, etc.) of the environment in which the apparatus is, but also, to precisely grasp how the conditions (temperature, humidity, etc.) continuously change. Therefore, the environment sensor is placed in the adjacencies of the developing apparatus 9M (first developing apparatus), which needs to be monitored in temperature.

As described above, the belt cleaning apparatus 14 is near the fixing apparatus 15, which is one of the heat sources of the image forming apparatus 60. Therefore, its increase in temperature is thought to be problematic. Thus, the effect of the increase in the internal temperature of the housing of the apparatus 60 upon the recovered toner in the belt cleaning apparatus 14 has come to be listed as one of the new problems.

In the full-color mode, the multiple developing apparatuses, more specifically, the developing apparatuses 9Y, 9M, 9C, and 9K simultaneously operate. Further, recent developing apparatuses (color image forming apparatuses) which are substantially higher in image quality than conventional developing apparatuses (color image forming apparatuses) are more intense in terms of magnetic properties and higher in the revolution of their rollers. Therefore, they are substantially greater in self-inflicted temperature increase, in particular, in the adjacencies of their bearings. In comparison, in the black-and-white mode, the developing apparatuses 9Y, 9M, and 9C, that is, the developing apparatuses for the formation of monochromatic color images, are not activated (development sleeve 9*b* is not rotated). Therefore, the temperature increase attributable to the heat generated by the bearings is not as high as that in the full-color mode. Thus, the full-color mode and black-and-white mode are quite different from each other in terms of the internal temperature of the belt cleaning apparatus 14 estimated from the output of the environment sensor 10.

Further, the full-color mode is different from the black-and-white mode in the number of developing apparatuses in which their rollers are rotated, being therefore different in the effects of the self-inflicted temperature increase. Therefore, they are different in the components to be monitored in temperature.

Referring to FIG. 5(*a*), in the full-color mode, the various components of the developing apparatus 9Y, 9M, 9C, and 9K rotate. Therefore, the developing apparatus 9Y, 9M, 9C, and 9K increase faster in temperature than the belt cleaning apparatus 14. Thus, the components to be monitored in temperature are the developing apparatuses. Generally speaking, the internal components of an image forming apparatus more rapidly increase in temperature when they are directly heated by their own heat sources than when their temperature is affected (indirectly heated) by the increase in the internal temperature of the housing of the apparatus. Therefore, in an operation in which a substantial number of images are continuously formed, the developing apparatuses 9Y, 9M, and 9C, which are increased in temperature by both their own heat sources and the increase in the internal temperature of the housing of the image forming apparatus, increase in temperature faster than the belt cleaning apparatus 14.

Next, referring to FIG. 5(*b*), in the black-and-white mode, the belt cleaning apparatus 14, instead of the developing apparatus 9M, is the component to be monitored in temperature, because it is the rotational components of only the developing apparatus 9K that is rotated in the black-and-white mode, and therefore, the amount by which the developing apparatus 9M is increased in temperature by its own heat source is small. Further, in order to minimize the image forming apparatus 60 in the length of time it takes for the apparatus 60 to output the first copy after being turned on, the image forming portion PK of the apparatus 60 is positioned at the downstream end of the apparatus 60 in terms of the recording medium conveyance direction. Therefore, its temperature is affected by natural heat radiation and/or air flow. Therefore, it is slower in the speed with which it increases in temperature than the other image forming portions.

Even though the full-color mode and black-and-white mode are different from each other in characteristic in terms of the temperature increase of the internal components of the image forming apparatus as described above, the control disclosed in Japanese Laid-open Patent Application 2008-107506 can detect only the temperature increase of a photosensitive drum, and cannot detect the pattern in which the developing apparatus 9M increases in temperature and the pattern in which the belt cleaning apparatus 14 increases in temperature.

In comparison, in the following preferred embodiments of the present invention, the exhaust fan 17 of the image forming apparatus 60 is turned on or off, and controlled in air volume, based on a single piece of information, more specifically, the temperature detected by the environment sensor 10.

Figure 6:
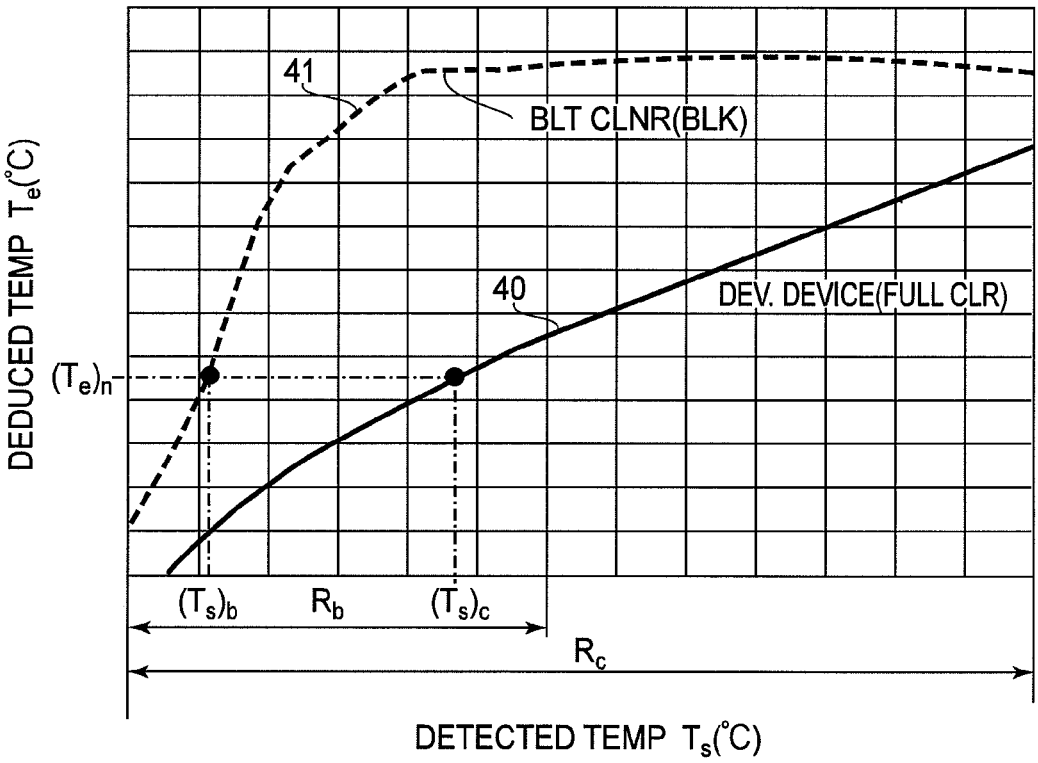
FIG. 6 is a graph which shows the relationship between the temperature detected by the environment sensor and estimated temperature of the one of the developing apparatuses, and the belt cleaning apparatus, of the image forming apparatus.

More specifically, a temperature sensor (10) is placed inside the housing of the image forming apparatus 60, in a position where it receives heat from both the first developing apparatus (9M) and the other heat sources of the apparatus 60. The air blowing means (17) is variable in the amount by which it blows air to ventilate the interior of the housing of the apparatus 60. A controlling means (54) controls the air blowing means (17) in response to the output of the temperature sensor (10) in such a manner that the higher the temperature, the greater the volume of air blown by the air blowing means (17). As the temperature detected by the temperature sensor (10) reaches a preset level, the amount by which air is blown by the air blowing means (17) is switched from the first volume to the second volume, which is greater by one step (preset amount) than the first volume. Thus, the temperature level preset for the controlling means (54) to switch the air blowing means (17) in air volume from the first volume to the second volume in response to the temperature detected by the temperature sensing element (10) in the first image formation mode (black-and-white) is lower than in the second image formation mode (full-color mode). Referring to FIG. 6, the second image formation mode (black-and-white mode) is lower than the first image formation mode (full-color mode), in the temperature level preset for the controlling means (54) to increase the air blowing means (17) in air volume in response to the increase in the temperature detected by the temperature sensor (10).

<Embodiment 1>

Figure 7:
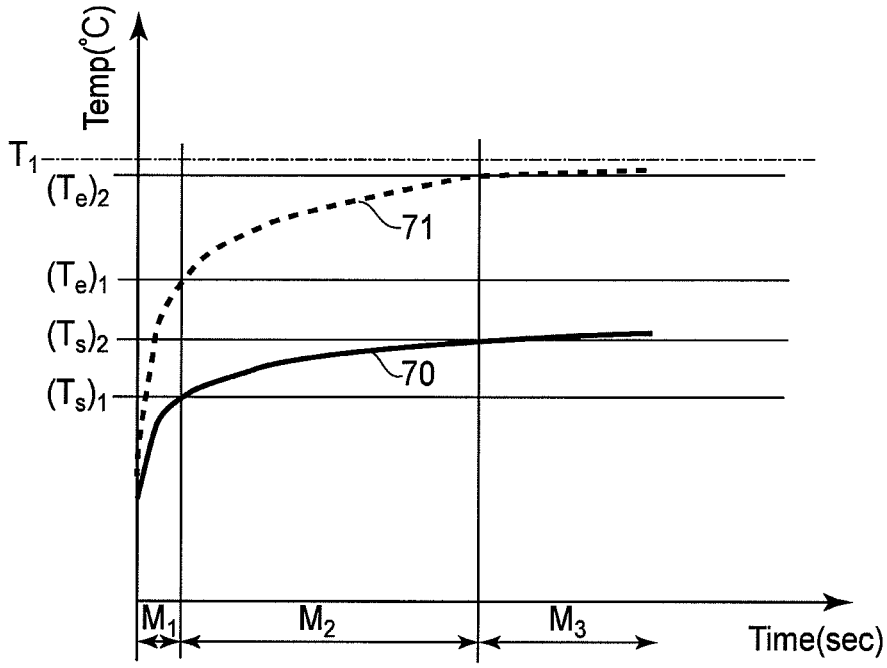
FIG. 7 is a graph for describing the method for controlling the exhaust fan in air volume in the black-and-white mode, in the first embodiment of the present invention.
Figure 8:
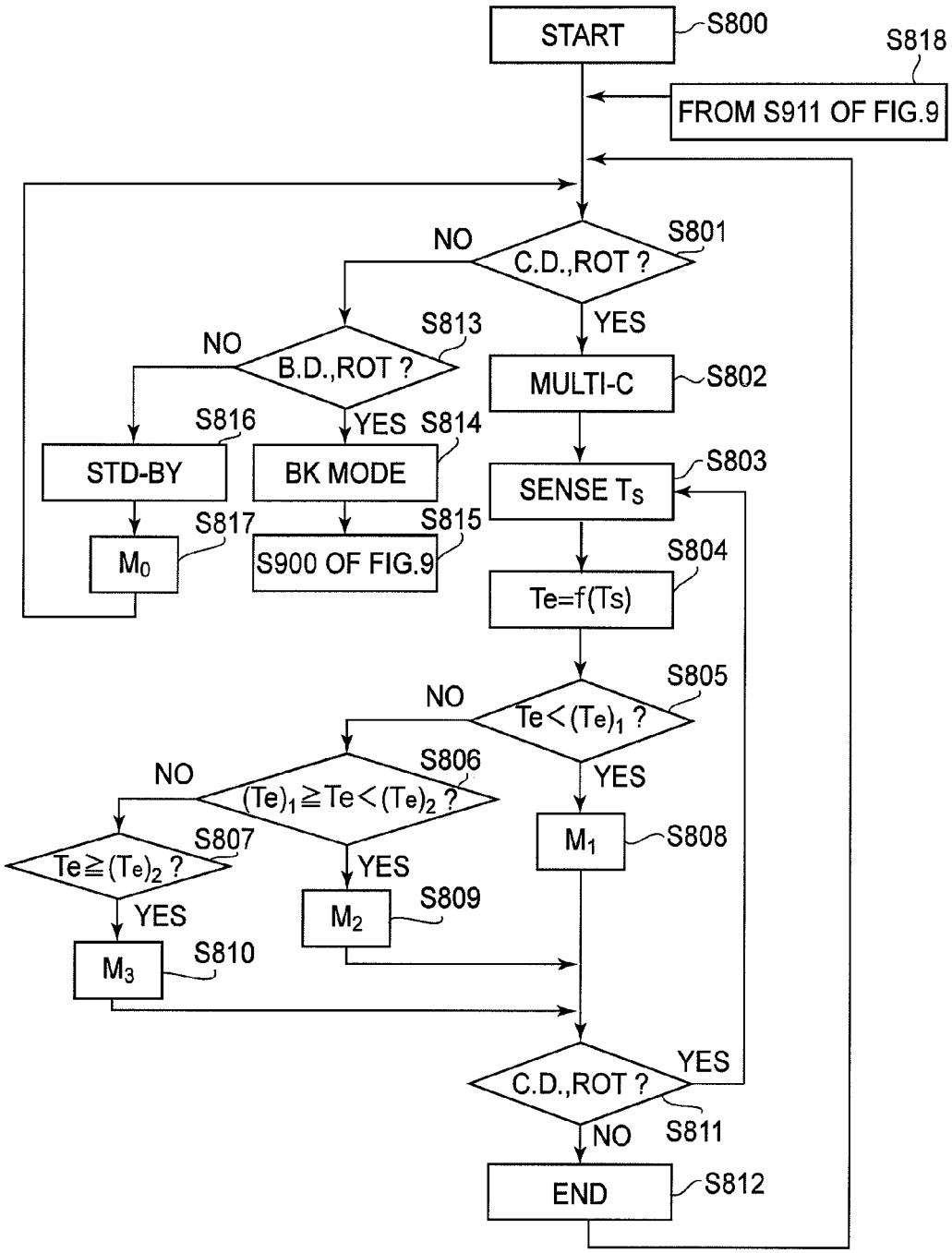
FIG. 8 is a flowchart of the sequence for controlling the exhaust fan in air volume in the full-color mode, in the first embodiment of the present invention.
Figure 9:
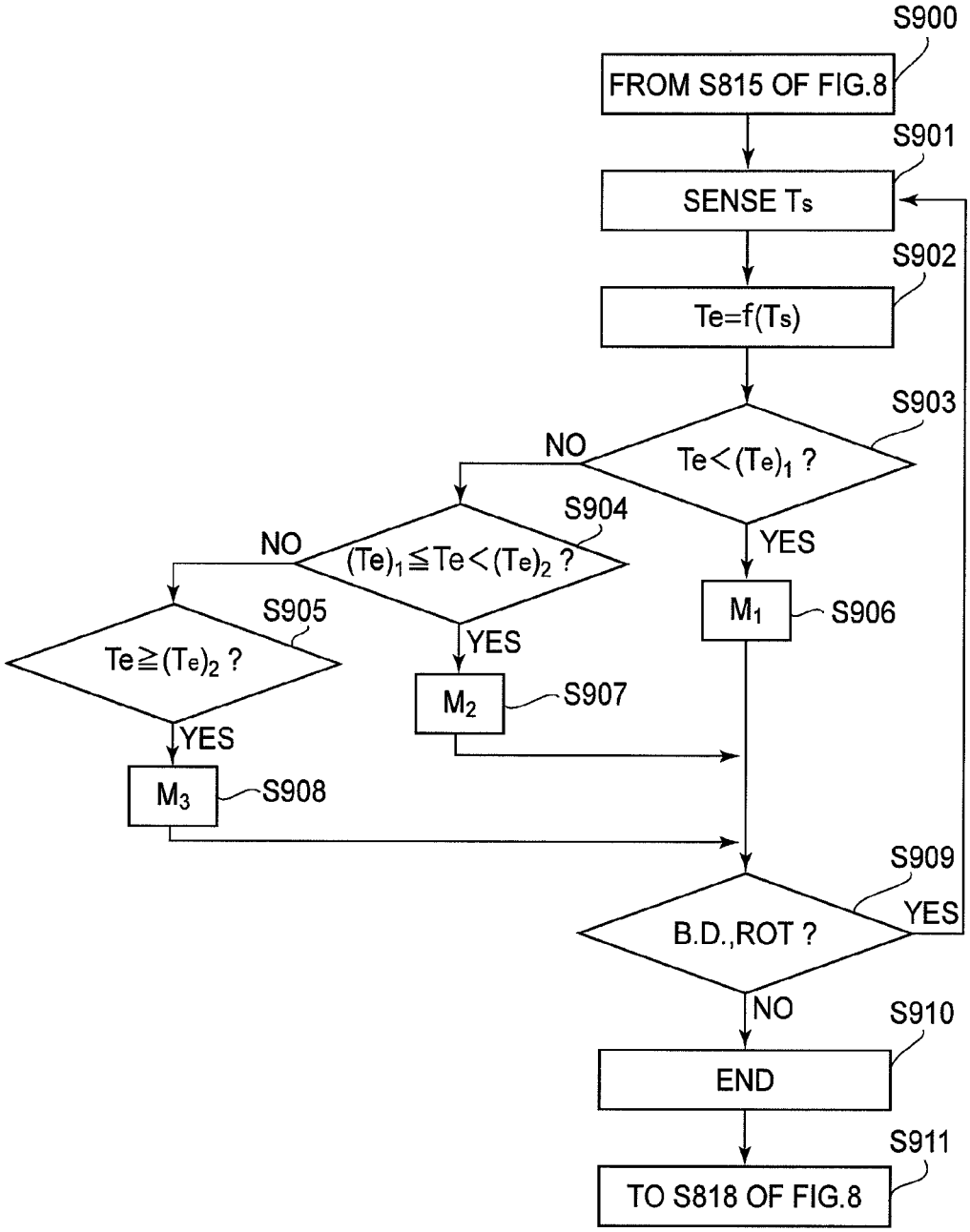
FIG. 9 is a flowchart of the sequence for controlling the amount by which air is blown into the image forming apparatus in the black-and-white mode, in the first embodiment of the present invention.

FIG. 6 is a graph which shows the relationship between the temperature detected by the environment sensor and temperature of the various portions of the image forming apparatus. FIG. 7 is a graph for describing the control of the exhaust fan in terms of air volume in the first preferred embodiment of the present invention. FIG. 8 is a flowchart of the sequence for controlling the exhaust fan in air volume in the full-color mode, in the first embodiment. FIG. 9 is a flowchart of the sequence for controlling the exhaust fan in air volume in the black-and-white mode, in the first embodiment.

Referring to FIG. 4, in the first embodiment, a control portion 54, which is made up of a CPU 50 and a memory 51, controls the exhaust fan 17. Into the control portion 54, the rotation detection signals from the encoders 53, which are in the adjacencies of the photosensitive drums 8Y, 8M, and 8C, the rotation detection signal from the encoder 52, which is in the adjacency of the photosensitive drum 8K, and the ambient temperature signal from the environment sensor 10, are inputted. Further, the control portion 54 is enabled to operate the image forming apparatus 60 in the first and second image formation modes, plays a role of controlling the air blowing means in such a manner that the higher the temperature sensed by the above-mentioned temperature sensor, the greater the air blowing means in air volume, and also, that the temperature level at which the air blowing means is increased in air volume in the second image formation mode is lower than that in the first image formation mode.

The memory 51 stores formulae (tables) for approximating the temperature of the various portions of the image forming apparatus 60 in the black-and-white mode and full-color mode. The CPU 50 determines whether the image forming apparatus 60 is in the full-color mode or black-and-white mode, from the pattern of combination among the rotation detection signals from the encoders 53 and 52, and selects the temperature approximation formula based on the determination. The temperature approximation formula is used to estimate the temperature Te of the component to be monitored in temperature, from the ambient temperature Ts in the housing of the apparatus 60, which is detected by the environment sensor 10. After estimating the temperature Te by computation, the CPU 50 outputs a command for controlling the exhaust fan 17 in the number of revolution.

In the first embodiment, a fan which can be varied in the number of revolution by PWM, that is, by changing in pulse width the electric power for driving the fan, is used as the exhaust fan 17. While the image forming apparatus 60 is actually operated for image formation, the exhaust fan 17 can be switched in operational mode, among three modes M1 (40% in duty ratio), M2 (70% in duty ratio), and M3 (100% in duty ratio), listing from the side lower in the number of revolution. While the image forming apparatus 60 is kept on standby, the exhaust fan 17 is kept in an operational mode M0 (30% in duty ratio).

A fan which can be controlled in speed by PWM can be easily changed in speed in steps. Obviously, the method for controlling the exhaust fan 17 in speed does not need to be PWM. For example, a fan can be changed in speed in steps by using a means for changing in voltage in steps the electric power supplied to the fan.

FIG. 6 is a graph, the horizontal axis of which represents the temperature Ts (° C.) detected by the environment sensor 10, and the vertical axis of which represents the estimated temperature Te (° C.) of the component to be monitored in temperature.

Referring to FIG. 4, in the first embodiment, the environment sensor 10 is in the adjacency of the developing apparatus 9M, and doubles as a component for obtaining the information (relative humidity) necessary to control the two-component developer in toner density.

As the means for precisely estimating the temperature of the belt cleaning apparatus, which is not in the adjacencies of the developing apparatus 9M, along with the information (relative humidity) necessary to control the developer in toner density, the method for detecting the ambient temperature with the use of the environment sensor 10 is appropriate. In this embodiment, therefore, a thermistor of the non-contact type is used, instead of a thermistor of the contact type, as the environment sensor 10.

Among the developing apparatuses 9Y, 9M, 9C, and 9K, the developing apparatuses 9Y and 9K which are the most upstream and most downstream ones, respectively, in terms of the moving direction of the intermediary transfer belt 1, are greater in the amount by which heat is allowed to radiate therefrom, and therefore, are smaller in the amount of temperature increase. In terms of temperature, not only is the developing apparatus 9C affected by the fixing apparatus 15, but also, it is more likely to be affected by the developing apparatus 9K than the developing apparatuses 9Y and 9M. Thus, the environment sensor 10 is positioned in the adjacencies of the developing apparatus 9M. In other words, in this embodiment, in order to minimize the image forming apparatus 60 in the number of the environment sensor (10) while ensuring the temperature of the components to be monitored in temperature is accurately estimated, the environment sensor 10 is placed in the adjacencies of the developing apparatus 9M, which is largest in the temperature fluctuation which occurs while the image forming apparatus 60 is in operation. Incidentally, the environment sensor 10 may be placed in the adjacency of the developing apparatus 9Y or 9C. Further, multiple environment sensors (10) may be placed in the adjacencies of the developing apparatuses 9Y, 9M, and 9C, one for one, so that the average value of the temperature detected by the multiple environment sensors (10) can be used as the ambient temperature of the interior of the apparatus 60.

The image forming apparatus 60 can be switched in operational mode between the black-and-white mode in which only the rotational components of the developing apparatus 9K are rotated, and the full-color mode in which the rotational components of the developing apparatuses 9Y, 9M, 9C, and 9K are rotated. Therefore, the black-and-white mode and full-color mode are different in the relationship among the temperature detected by the environment sensor 10, and estimated temperature of the components to be monitored in temperature, as shown in FIGS. 5(*a*) and 5(*b*).

FIG. 6 is a graph which shows the relationship among the temperature detected by the environment sensor 10, and the temperature of the components to be monitored in temperature, which are estimated based on the relationship in temperature increase among the temperature detected by the environment sensor 10, and the temperature of the developing apparatuses and belt cleaning apparatus, given in FIG. 5. In FIG. 6, a solid line 40 represents the changes in the estimated temperature of the developing apparatus 9M (fastest in temperature increase), that is, the component to be monitored in temperature, in the full-color mode. A broken line represents the changes in the estimated temperature of the belt cleaning apparatus 14 in the black-and-white mode.

As for the characteristic features of the two formulae for estimating the temperature of the components to be monitored in temperature, the solid line which represents the black-and-white mode is greater in slope than the broken line which represents the full-color mode, during a low temperature period (in which temperature detected by environment sensor 10 begins to rise), because the black-and-white mode and full-color mode are very different in the amount of heat which the environment sensor 10 receives from the self-inflicted portion of the temperature increase of the developing apparatuses 9Y, 9M, and 9C. In the black-and-white mode, the temperature increase of the belt cleaning apparatus 14 is greater than the increase in the temperature sensed by the environment sensor 10.

Thus, the changes in the temperature detected by the environment sensor 10 while the image forming apparatus 60 is actually forming images in the full-color mode fall in a range Rc shown in FIG. 6, whereas that in the black-and-white mode falls in a range Rb shown in FIG. 6, which is narrower than the range Rc.

FIG. 7 shows the changes in the temperature detected by the environment sensor 10 and the changes in the estimated temperature of the developing apparatus 9M, which resulted from the control of the exhaust fan 17 based on the formula (table), in FIG. 6, for approximating the temperature of the developing apparatus 9M. In FIG. 7, the horizontal axis stands for elapsed time, and the vertical axis stands for temperature level (° C.). A solid line 70 represents the changes in the temperature detected by the environment sensor 10 in the full-color mode, and a broken line 71 represents the changes in the temperature of the developing apparatus 9M in the full-color mode.

Referring to FIG. 7, Tf stands for the preset target temperature level for the developing apparatus 9M, which is the component to be monitored in temperature. In the first embodiment, in order to prevent the estimated temperature Te of the developing apparatus 9M from increasing beyond the temperature level Tf, the exhaust fan 17 is switched in operational mode among modes M1, M2, and M3 to increase the exhaust fan 17 in air volume in steps; it is switched from mode M1 to mode, M2 (between modes M1 and M2) at threshold level (Te)1), and from mode M2 to mode M3, at threshold level (Te)2 (between modes M1 and M2).

It is evident from FIG. 6, which shows the correlation between the temperature detected by the environment sensor 10 and the estimated temperature level Te of the component to be monitored in temperature, that there are a temperature levels (Ts)1 and (Ts)2, which correspond to the threshold levels (Te)1 and (Te)2, respectively. In other words, as the temperature detected by the environment sensor 10 reaches (Ts)1 and (Ts)2, the exhaust fan 17 is switched in air volume by a preset amount (in step).

Further, temperature levels (Ts)1 and (Ts)2 which correspond to the threshold levels (Te)1 and (Te)2 in the black-and-white mode, which are shown in FIG. 7, are set for the belt cleaning apparatus 14 (which corresponds to broken line in FIG. 17) as well. The temperature levels (Ts)1 and (Ts)2 set for the cleaning apparatus 14 are different in value from those set for the developing apparatus 9M.

Referring to FIG. 6, it is assumed that the exhaust fan 17 is switched in the number of revolution at a threshold level (Te)n. Based on the difference in characteristic between the full-color mode and black-and-white mode, which was previously described, the threshold levels (Ts)b set for the temperature detected by the environment sensor 10 in the black-and-white mode is made lower than that (Ts)c in the full-color mode.

It is possible to make the black-and-white mode and full-color mode different in the threshold level (Te)n. However, the range Rb in which the temperature level detected by the environment sensor 10 varies in the black-and-white mode is narrower than the range Rc in which the temperature level detected by the environment sensor 10 varies in the full-color mode (Rb<Rc). In other words, in the black-and-white mode, the estimated temperature Te of the components to monitored in temperature converges to the preset value while the temperature level Ts detected by the environment sensor 10 is relatively low. Therefore, in order to prevent the exhaust fan 17 becoming higher or lower in air volume than necessary, the values for the threshold temperature levels (Te)1 (first threshold level) are set so that the relationship between (Ts)b becomes lower than (Ts)c ((Ts)b<(Ts)c).

<Flowchart in Embodiment 1>

Referring to FIG. 8, along with FIGS. 1 and 4, as the electric power source of the image forming apparatus 60 is turned on (S800), the CPU 50 detects whether or not the rotational components of the developing apparatus 9Y, 9M, and 9C, and the rotational components of the developing apparatus 9K are rotating through the encoders 53 and 52, respectively (S801). If the rotation is detected by the encoders 53 (Yes in S801), the CPU 50 determines that the image forming apparatus 60 is in the full-color mode (S802), whereas if the rotation is detected by only the encoder 52 (Yes in S813), the CPU 50 determines that the image forming apparatus 60 is in the black-and-white mode (S814).

If rotation is detected neither by encoders 53 nor 52 (No in S813), The CPU 50 determines that the image forming apparatus 60 is in the standby mode (S816). In the first embodiment, if the CPU 50 determines that the image forming apparatus 60 is in the standby mode (S816), the CPU 50 selects the mode M0, which is lower in the number of revolution of the exhaust fan 17 than the operational mode M1, from the standpoint of reducing the image forming apparatus 60 in noise, and keeps the image forming apparatus 60 in the operational mode M0 regardless of the value of the temperature level Ts detected by the environment sensor 10 (S817).

In the full-color mode, the CPU 50 samples the temperature detected by the environment sensor 10 (S803), and obtains the value of the estimated temperature level Te of the developing apparatus 9M by computation (S804).

In the first embodiment, during the actual formation of images, the exhaust fan 17 is operated in one of the three operational modes, that is, modes M1, M2, and M3, which are different in the number of revolution of the exhaust fan 17. Further, the levels (Te)1 and (Te)2 are preset at which the exhaust fan 17 is switched in operational mode. That is:

(1) If the estimated (by computation) temperature Te is less than (Te)1 (Te<(Te)1) (Yes in S805), the CPU 50 selects the operational mode M1, which is lowest in the number of the revolution of the exhaust fan 17 (S808).

(2) If the estimated (by computation) temperature level Te is no less than (Te)1 and less than (Te)2 ((Te)1≤Te<(Te)2 (Yes in S806), the CPU 50 selects the operational mode M2 which is higher in the number of the revolution of the exhaust fan 17 (S809).

(3) If the estimated (by computation) temperature level Te is no less than (Te)2:(Te≥(Te)2) (Yes in S807), the CPU 50 selects the operational mode M3 which is highest in the number of the revolution of the exhaust fan 17 (S810).

The cooling performance setting (amount of air volume) which is optimal for the rate of increase in the internal temperature of the housing of the image forming apparatus 60 is determined as described above. Thereafter, the revolution of the above-mentioned components are detected again by the encoders 53 and 52 (S811). As long as the image forming apparatus 60 is in the full-color mode (Yes in S811), the routine for returning to the control step S803 is carried out each time the temperature level detected by the environment sensor 10 is sampled.

However, if no rotation is detected either by the encoder 53 nor 52 (No in S811), the CPU 50 determines that the print job which was to be carried out in the full-color mode has been completed (S812), and returns to the step in which it determines which operational mode the image forming apparatus 60 is.

On the other hand, if the CPU 50 determines that the image forming apparatus 60 is in the black-and-white mode (S814), it proceeds from a control step S815 to a control step S900 shown in FIG. 9. The control step S901 and the steps thereafter are the same as the counterparts in the control sequence for the full-color mode, which was described with reference to FIG. 8, except that the temperature level Te estimated by computation from the temperature level Ts detected by the environment sensor 10 is for the belt cleaning apparatus 14.

Also in the black-and-white mode, as long as a printing job is continuously carried out (Yes in S909), the routine for returning to the control step S901 is carried out each time the temperature detected by the environment sensor 10 is sampled. If the revolution is not detected by the encoder 52 (No in S909), the CPU 50 determines that the print job has been completed (S910), and returns to the control step S818 of the flowchart given in FIG. 8.

<Embodiment 2>

Figure 10:
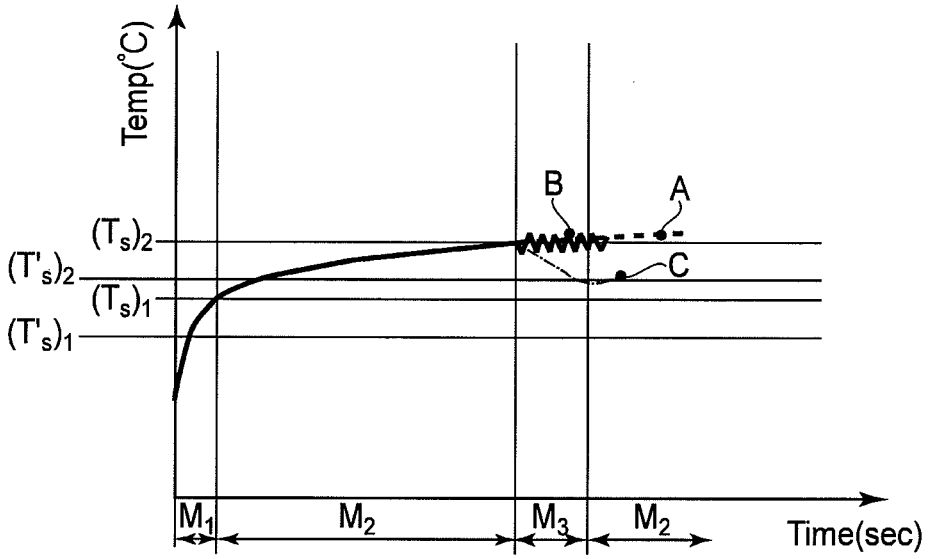
FIG. 10 is a graph for describing the method for controlling the exhaust fan in air volume in the second embodiment.
Figure 11:
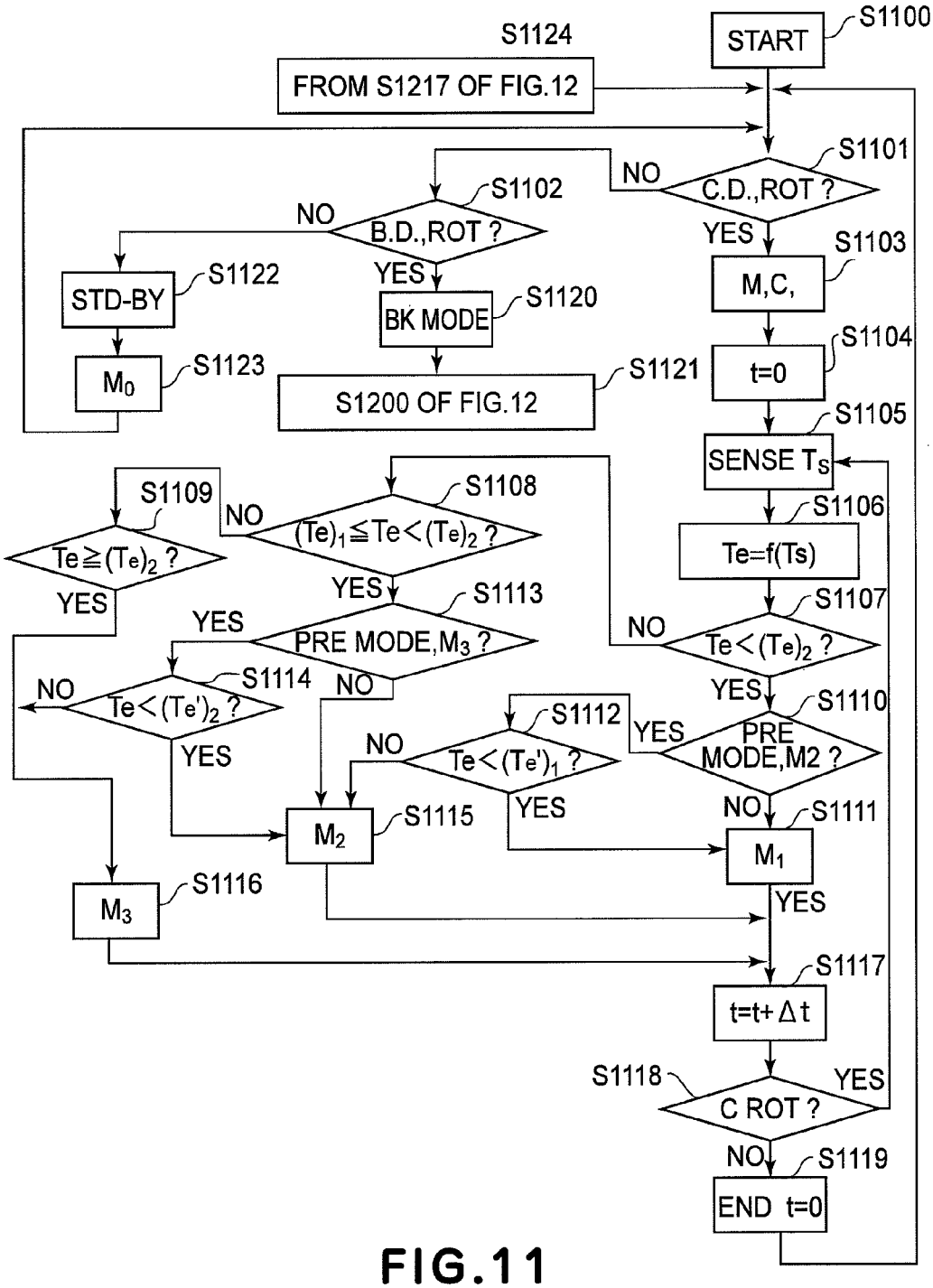
FIG. 11 is a flowchart of the sequence for controlling the exhaust fan in air volume in the full-color mode, in the second embodiment of the present invention.
Figure 12:
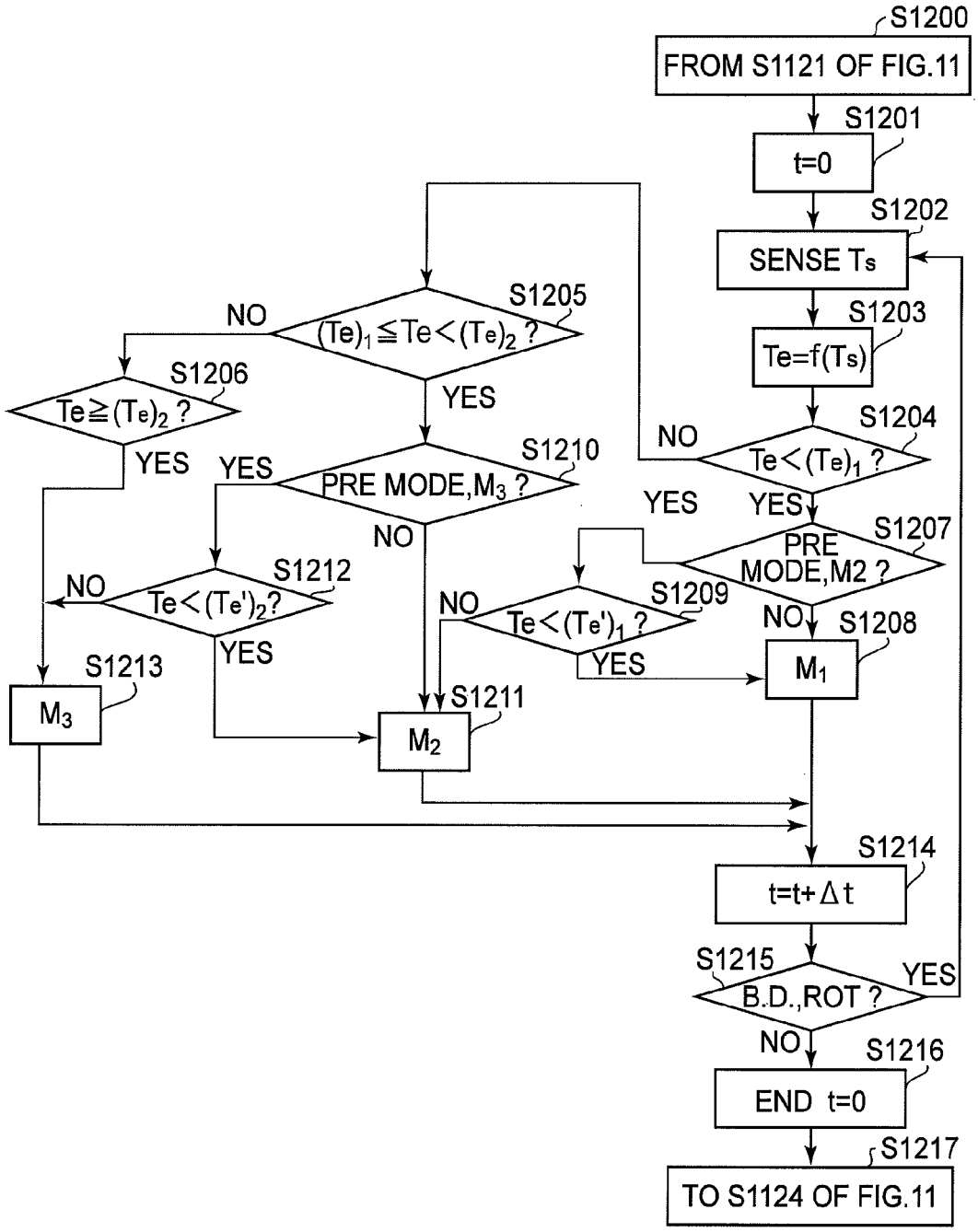
FIG. 12 is a flowchart of the sequence for controlling the exhaust fan in air volume in the black-and-white mode, in the second embodiment of the present invention.

FIG. 10 is a graph for describing the control of the exhaust fan in air volume in the second embodiment. FIG. 11 is a flowchart of the sequence for controlling the exhaust fan in air volume in the full-color mode, in the second embodiment. FIG. 12 is a flowchart of the sequence for controlling the exhaust fan in air volume in the black-and-white mode, in the second embodiment. The second embodiment also is related to the image forming apparatus 60 described previously with reference to FIGS. 1-6. Therefore, the components, portions, etc., of the image forming apparatus in the second embodiment, which are the same as the counterparts in the first embodiment will not be described here.

Referring to FIG. 10, in the second embodiment, threshold levels (Ts)1 and (Ts)2 which correspond to the temperature detected by the environment sensor 10 are set as they were set in the first embodiment. That is, the black-and-white mode is set lower in the threshold levels (Ts)1 and (Ts)2 than the full-color mode.

However, in the second embodiment, threshold levels (Te')1 and (Te')2 are set exclusively for the downward change in the temperature level detected by the environment sensor 10. In other words, the exhaust fan 17 is switched in air volume (number of revolution) with the presence of the so-called hysteresis to prevent the exhaust fan 17 fluctuating (B) in air volume when the temperature level detected by the environment sensor 10 is in the adjacencies of the threshold level (Ts)1. FIG. 10 shows the relationship between the control of the exhaust fan 17 after the starting of an image forming operation in which a substantial number of images are continuously formed (which hereafter may be referred to simply as continuous image forming operation), and the resultant changes which occurred to the temperature level detected by the environment sensor 10 with elapse of time.

When the image forming apparatus 60 is used for an image forming operation in which the recording medium P is thick paper, that is, paper which is relatively large in basis weight, or paper coated for glossiness, it is reduced in recording medium conveyance speed to ½, ⅓, or the like of the normal speed in order to increase the amount by which heat is given to the recording medium P per unit length of time by the fixing apparatus 15.

In this case, the developing apparatus 9M also reduces in the number of revolution of its rotational components, and therefore, reduces in the amount by which it is increased in temperature by its own heat sources. This occurs, in particular, when the image forming apparatus 60 is used for a printing job which is carried out in the black-and-white mode using thick paper as the recording medium P. The single-dot broken line C in FIG. 10 represents the temperature changes which occurred during such a printing job. The simple broken line A represents the temperature changes which occurred when the temperature of the developing apparatus 9M was significantly increased by its own heat sources, for example, when the image forming apparatus 60 is operated in the full-color mode using the ordinary paper as the recording medium P, and therefore, the image forming apparatus 60 is not reduced in the recording medium conveyance speed.

The operations represented by the single-dot broken line C and broken line A were likely to become different in pattern after the temperature detected by the environment sensor 10 reached the threshold level (Ts)2 and the exhaust fan 17 was switched in operational mode from the operational mode M2 to the operational mode M3.

More specifically, in the operation, represented by the broken line A, in which the temperature increase of the developing apparatus 9M was significantly affected by its own heat sources, as the exhaust fan 17 was switched in operational mode from the operational mode M1 to operational mode M2, and then, from the operational mode M2 to the operational mode M3, that is, as the exhaust fan 17 was increased in cooling effect in steps, the rate with which the temperature of the developing apparatus 9M increases reduces. However, even after the exhaust fan 17 was switched in operational mode to the operational mode M3, the temperature detected by the environment sensor 10 continues to increase although rather gently. On the other hand, in the operation, represented by the single-dot broken line C, in which the amount by which the developing apparatus 9M is increased in temperature by its own heat sources was not significant, as soon as the exhaust fan 17 was switched in operation mode to operational mode M3, in which the exhaust fan 17 was highest in air volume, the temperature detected by the environment sensor 10 began to decrease instead of increasing.

As described above, the various modes in which the image forming apparatus 60 can be operated complicate the apparatus 60 in the thermal system in its housing. In the second embodiment, therefore, the threshold levels (Ts)1 and (Ts)2 are set for controlling the exhaust fan 17 exclusively when the temperature level detected by the environment sensor 10 is increasing, and the threshold levels (Te')1 and (Te')2 are set for controlling the exhaust fan 17 exclusively when the temperature level detected by the environment sensor 10 is decreasing. Therefore, the exhaust fan 17 is smoothly changed in air volume.

If the exhaust fan 17 is switched in operational mode at threshold levels (Ts)1 and (Ts)2 regardless of whether the temperature detected by the environment sensor 10 is increasing or decreasing, without setting up the threshold levels (Te')1 and (Te')2 for the temperature decrease, the temperature detected by the environment sensor 10 sometimes fluctuates as indicated by the solid line B in FIG. 10.

If the amount by which the developing apparatus 9M is increased in temperature by its own heat sources is relatively small, the sequence in which the exhaust fan 17 is increased in air volume, the temperature detected by the environment sensor 10 decreases, and the exhaust fan 17 is downwardly switched in operational mode in terms of the number of the revolution, and the sequence in which the temperature detected by the environment sensor 10 increases because the downward switching of the exhaust fan 17 in operational mode in terms of the number of revolution, and the exhaust fan 17 is upwardly switched in operational mode in terms of the number of revolution, are alternately repeated. In other words, the exhaust fan 17 is repeatedly switched in the number of revolution, being thereby caused to generate very unpleasant operational noises. According to the exhaust fan control in the second embodiment, however, the exhaust fan 17 is operated in the operational mode M3 until the temperature detected by the environment sensor 10 falls to the threshold level (Te')2 dedicated to the decrease in the temperature detected by the environment sensor 10 as indicated by the single-dot broken line C. Therefore, this problem does not occur.

<Flowchart of Second Embodiment>

Referring to FIG. 11 along with FIGS. 1 and 4, as the electric power source of the image forming apparatus 60 is turned on (S1100), the CPU 50 detects whether or not the rotational components of the developing apparatus 9Y, 9M, and 9C, and the rotational components of the developing apparatus 9K are rotating, through the encoders 53 and 52, respectively (S1101). If the rotation is detected by the encoders 53 (Yes in S1101), the CPU 50 determines that the image forming apparatus 60 is in the full-color mode (S1103), whereas if the rotation is detected by only the encoder 52 (Yes in S1102), the CPU 50 determines that the image forming apparatus 60 is in the black-and-white mode (S1120).

If rotation is detected neither by encoders 53 nor 52 (No in S1102), the CPU 50 determines that the image forming apparatus 60 is in the standby mode (S1122), and selects the mode M0, which is lower in the number of revolution of the exhaust fan 17 than the operational mode M1 (S1123).

If the CPU 50 determines that the image forming apparatus 60 is in the full-color mode (S1103), it sets the timer to zero (t=0 second) (S1104), and samples the temperature Ts detected by the environment sensor 10 (S1105). Then, it estimates the temperature level Te of the developing apparatus 9M by computation from the correlation described with reference to FIG. 6 (S1106).

If the estimated (by computation) temperature level Te is less than (Te)1 (Te<(Te)1 (Yes in S1107), the CPU 50 checks whether or not the operational mode in which the exhaust fan 17 has been operated is M2 or not (S1110). If it determines that the operational mode was not M2 (No in S1110), it determines that there is no operational mode in which the exhaust fan 17 has been operated, and unconditionally selects the operational mode M1 (S1111). However, when the temperature detected by the environment sensor 10 is sampled next time and thereafter, the CPU 50 selects an operational step based on the decision made in the control step S1110.

If the decision made in the control step S1110 is Yes, for example, it means that the temperature detected by the environment sensor 10 crossed the threshold level (Te)1 while it was decreasing, and therefore, is compared with the threshold level (Te')1 dedicated to the temperature decrease (S1112). If the condition (Te<(Te')1) is satisfied, the CPU 50 selects the operational mode M1 (S1111), whereas if it is not satisfied, the CPU 50 keeps the exhaust fan 17 in the operational mode M2 (S1115).

If the estimated (by computation) temperature level Te is no less than (Te)1 and less than (Te)2 (Yes in S1108), the CPU 50 checks whether or not the operational mode in which the exhaust fan 17 has been operated was M3 or not (S1113), and also, whether or not the temperature has been increasing or decreasing.

If the exhaust fan 17 has been operated in the operational mode M3 (Yes in S1113), it means that the temperature detected by the environment sensor 10 crossed the threshold level (Te)2 dedicated to the temperature increase, during the temperature decrease, and compares the temperature detected by the environment sensor 10 with the threshold level (Te')2 dedicated to the temperature decrease (S1114). If a condition (Te<(Te')2 is satisfied (Yes in S1114), the CPU 50 selects the operational mode M2 (S1115). If the condition is not satisfied, the CPU 50 keeps the exhaust fan 17 in the operational mode M3 (S1116).

If the estimated (by computation) temperature level Te is no less than (Te)2 (Yes in S1109), the CPU 50 unconditionally selects the operational mode M3 (S1116).

That is, the operational mode of the exhaust fan 17 at a given point t in time is set through the above described sequence. Thereafter, the sampling time is reset to t+Δt sec (sampling interval) (S1117), and the rotation is detected by the encoders 53 (S1118). If the rotation is detected by the encoders 53 (Yes in S1118), the CPU 50 determines that the printing job is still going on in the full-color mode, and repeats the routine for returning to the control step S1105. However, if the rotation is not detected by the encoders 53 (No in S1118), the CPU 50 determines that the printing job in the full-color mode has ended, and resets the timer. Then, it returns to the operational step for checking the state of operation (S1119).

If the rotation is detected by the encoders 53 (Yes in S1118), the CPU 50 determines that the printing job in the full-color mode is going on, and carries out the routine for returning to the control step S1105. However, if no rotation is detected by the encoders 53 (No in S1118), the CPU 50 determines that the print job in the full-color mode has been ended, and resets the timer. Then it returns to the operational step in which the state of operation is checked (S1119).

On the other hand, if the CPU 50 determined that the image forming apparatus 60 is in the black-and-white mode (S1120), it proceeds to a control step S1200 as shown in FIG. 12. The control step S1201 and the steps thereafter are basically the same as the counterparts in the control sequence for the full-color mode, which was described with reference to FIG. 12, except that the temperature level Te estimated by computation from the temperature Ts detected by the environment sensor 10 is for the belt cleaning apparatus 14.

Also in the black-and-white mode, as long as a printing job is continuously carried out (Yes in S1215), the routine (S1202-S1215) is carried out each time the temperature level detected by the environment sensor 10 is sampled. If the rotation is not detected by the encoder 52 (No in S1215), the CPU 50 determines that the printing job has been ended (S910), and resets the timer (S1216). Then, it returns to the flowchart given in FIG. 11 (S1217).

<Embodiment 3>

Figure 13:
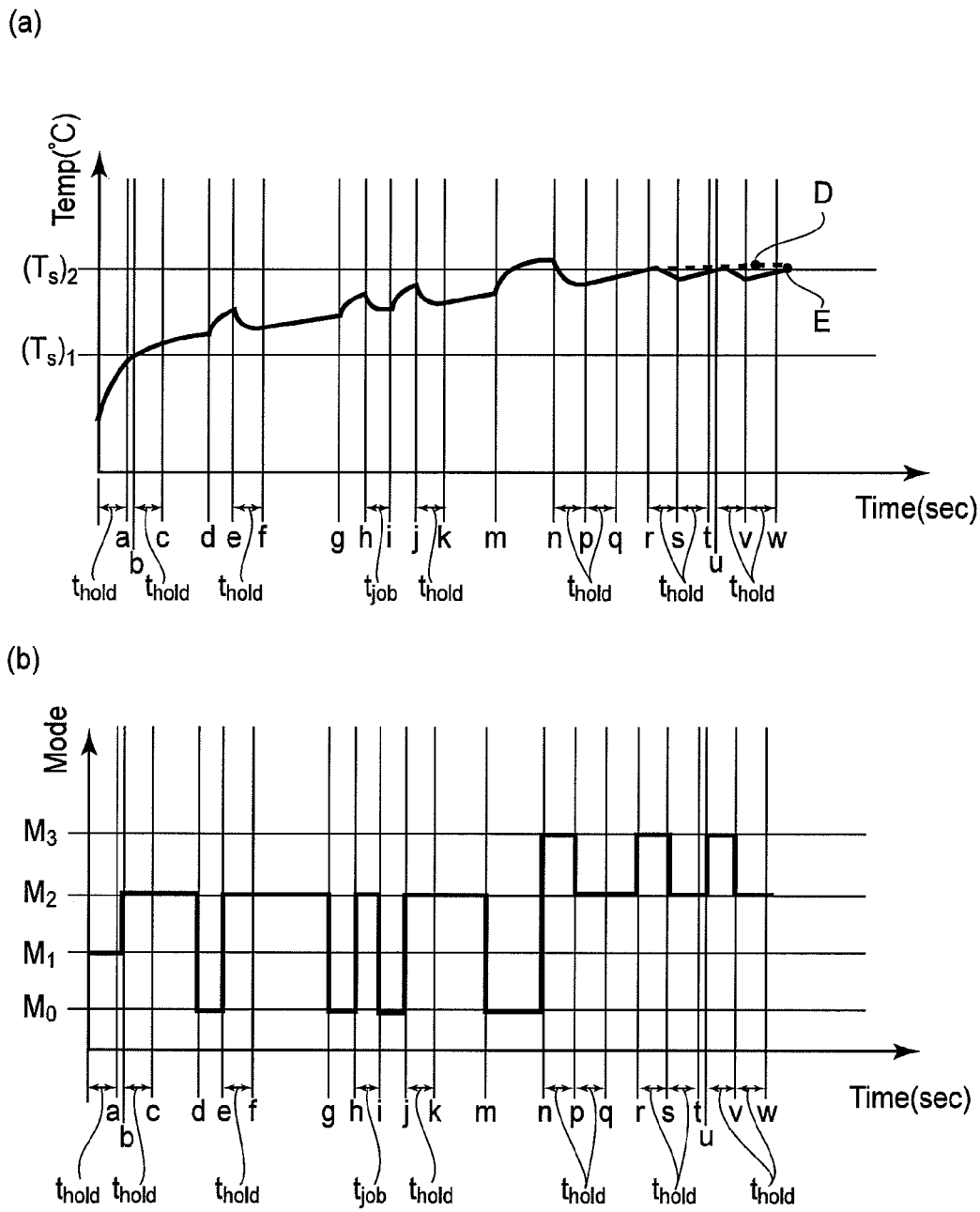
FIGS. 13(*a*) and 13(*b*) are graphs for describing the method for controlling the exhaust fan in air volume in the third embodiment of the present invention.
Figure 14:
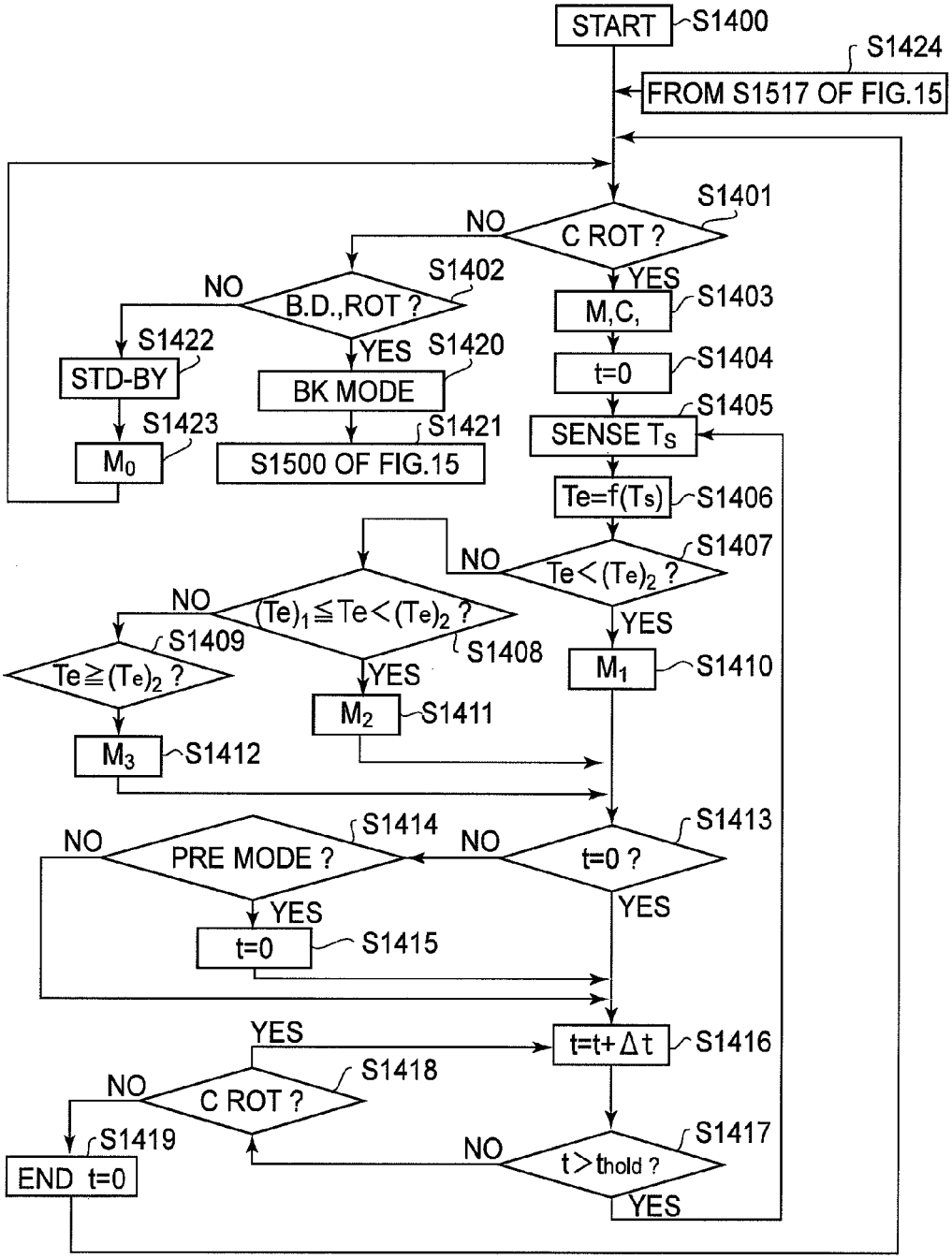
FIG. 14 is a flowchart of the sequence for controlling the exhaust fan in air volume in the full-color mode, in the third embodiment of the present invention.
Figure 15:
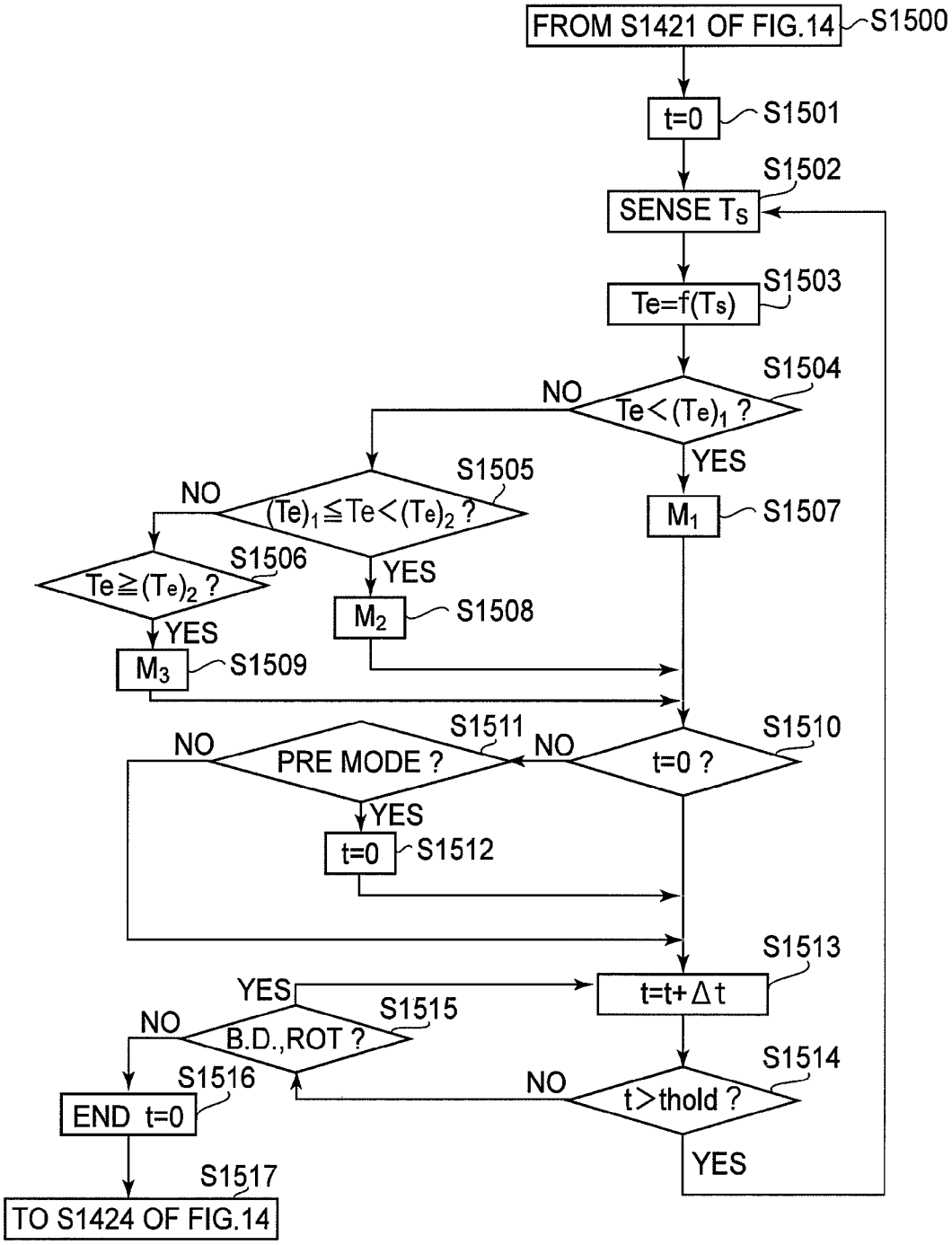
FIG. 15 is a flowchart of the sequence for controlling the exhaust fan in air volume in the black-and-white mode, in the third embodiment of the present invention.

FIGS. 13(*a*) and 13(*b*) are drawings for describing the control of the exhaust fan in air volume, in the third embodiment. FIG. 14 is a flowchart of the control of the exhaust fan in air volume in the full-color mode, in the third embodiment. FIG. 15 is a flowchart of the control of the exhaust fan in air volume in the black-and-white mode, in the third embodiment. The third embodiment also is related to the image forming apparatus 60 which was described with reference to FIGS. 1-6. Therefore, the image forming apparatus (60) in the third embodiment will not be described.

FIG. 13(*a*) shows the changes in the temperature detected by the environment sensor 10, which occurred as the exhaust fan 17 was controlled in air volume. FIG. 13(*b*) shows the pattern in which the exhaust fan 17 was switched in operational mode in a printing job in which the exhaust fan 17 was intermittently placed in the standby mode.

Referring to FIG. 13(*a*), in the third embodiment, the threshold levels (Ts)1 and (Ts)2, with which the temperature detected by the environment sensor 10 was compared during the increase in the temperature, were set as in the first embodiment. Further, the threshold levels (Ts)1 and (Ts)2 were set so that their values for the black-and-white mode were smaller than those for the full-color mode.

Also in the third embodiment, as the temperature detected by the environment sensor 10 reaches the threshold levels (Ts)1 and (Ts)2, the exhaust fan 17 is switched in operational mode. However, in the third embodiment, even if the temperature detected by the environment sensor 10 falls after the switching of the exhaust fan 17 in operational mode, the exhaust fan 17 is kept in the same operational mode for a preset length of time. That is, after a given operational mode is selected, the exhaust fan 17 is kept in this mode for a preset length $t_{hold}$ (sec) of time regardless of the temperature detected by the environment sensor 10, in order to prevent the exhaust fan 17 from fluctuating in air volume while the temperature is in the adjacencies of the threshold level (Ts)2.

Referring to FIG. 13(*b*), it is in the standby mode that the operation mode M0 was selected. Next, referring to FIG. 13(*a*), it is evident that during this period (in standby mode), the temperature detected by the environment sensor 10 while the temperature was increasing drastically changed in the rate of increase. The reason for the occurrence of this phenomenon is that in the standby mode, the exhaust fan 17 reduces in the number of revolution, and therefore, the ambient temperature within the housing of the image forming apparatus 60 overshoots. Therefore, in the third embodiment, as the next printing job is started and the exhaust fan 17 increases in the number of revolution, the rate at which the temperature detected by the environment sensor 10 increases returns to preceding rate in roughly 10 minutes. In the third embodiment, therefore, in consideration of this characteristic of the image forming apparatus 60, the interval $t_{hold}$ is set to 15 minutes.

As the operational mode M1 is selected based on the temperature detected by the environment sensor 10 at the beginning of the starting of a printing job, the exhaust fan 17 is kept in the operational mode M1 for a preset length of time $t_{hold}$ regardless of the temperature detected by the environment sensor 10 (—point a in time). As time elapses past point a in time, the CPU 50 moves to a step in which the operation mode for the exhaust fan 17 is selected based on the temperature detected by the environment sensor 10, and the exhaust fan 17 is kept in the operational mode M1 until a point b in time at which the temperature detected by the environment sensor 10 reaches the threshold level (Ts)1 at which the exhaust fan 17 is switched in operational mode from the operational mode M1 to the operational mode M2.

After the exhaust fan 17 is switched in operational mode to the mode M2 at the point b in time, the exhaust fan 17 is kept in the operational mode M2 for a preset length of time $t_{hold}$, that is, until a point c in time. Immediately after the point c in time, the control step in which the operational mode for the exhaust fan 17 is selected based on the temperature detected by the environment sensor 10 is started. Then, the exhaust fan 17 is kept in the operational mode M2 because until a point d in time. The temperature detected by the environment sensor 10 does not reach the threshold level (Ts)2 at which the exhaust fan 17 is to be switched in operational mode from M2 to M3.

As soon as the exhaust fan 17 is put in the standby mode (operational mode M0), the temperature detected by the environment sensor 10 overshoots until the point d in time at which the next printing job is accepted.

As the operational mode M2 is selected based on the temperature detected by the environment sensor 10 at a point e in time at which the next printing job is started, the exhaust fan 17 is kept in the operational mode M2 for a preset length of time $t_{hold}$ regardless of the value of the temperature detected by the environment sensor 10.

Thereafter, this control sequence is repeated. However, if the length $t_{job}$ of time it takes for a printing job to be completed is shorter than the length $t_{hold}$ of time, the time $t_{hold}$ is ended at the point in time at which the printing job is ended.

The control in the third embodiment keeps the exhaust fan 17 in a given operational mode for the length $t_{hold}$ in time. Therefore, it is effective to restore the apparatus 60 in the rate of temperature increase while preventing the temperature detected by the environment sensor 10 from overshooting in the standby mode. That is, in the standby mode, the developing apparatus 9M does not operate, and therefore, stops being increased in temperature by its own heat source. Therefore, if the level at which the developing apparatus 9M will be in temperature is estimated based on the correlation shown in FIG. 6, it is likely to be excessively high. In the third embodiment, therefore, the exhaust fan 17 is kept in the operational mode into which it has just been switched, for the length $t_{hold}$ of time to quickly eliminate the state in which the temperature detected by the environment sensor 10 excessively increases relative to the level at which the components to be monitored in temperature are estimated to be in temperature. Therefore, the control in the third embodiment is effective to the restore the apparatus 60 in terms of the temperature detected by the environment sensor 10 so that the level at which the temperature of the components to be monitored in temperature can be accurately estimated based on the correlation shown in FIG. 6.

Incidentally, not only does the temperature detected by the environment sensor 10 overshoot in the standby mode, but also, during paper jam or the like problems, and also, while the recording medium cassette 61 is replenished with sheets of paper. Also in these situations, this control of keeping, for the preset length $t_{hold}$ of time, the exhaust fan 17 in the operational mode into which the exhaust fan 17 has just been switched, provide the same effects as the above described one.

Further, the control in the third embodiment, which keeps the exhaust fan 17 in the operational mode into which the exhaust fan 17 has just been put for the preset length $t_{hold}$ of time can prevent the problem that the exhaust fan 17 generates unpleasant noises by being repeatedly changed in the number of revolution. As will be evident from the description of the second embodiment, the phenomenon that the exhaust fan 17 is repeatedly changed in the number of revolution occurs as the developing apparatus 9M reduces in the amount by which it is increased in temperature by its own heat sources, for example, in a case where the image forming apparatus 60 is reduced in the recording medium conveyance speed (½, ⅓, etc.) when thick paper is used as the recording medium P.

Referring to FIG. 13(*a*), a broken line D represents the changes in the temperature detected by the environment sensor 10, which occurred when the developing apparatus 9M was large in the amount by which it was increased in temperature by its own heat source after a point r in time. In this case, even if the temperature detected by the environment sensor 10 reaches the threshold level (Ts)2 and the exhaust fan 17 is switched in operational mode to the mode M3, the temperature detected by the environment sensor 10 continues to slowly increases or remains constant. In comparison, a solid line E represent the changes in the temperature detected by the environment sensor 10, which occurred when the amount by which the developing apparatus 9M was increased in temperature by its own heat sources was small. In this case, as the temperature detected by the environment sensor 10 reached the threshold level (Ts)2 and the exhaust fan 17 was switched in operational mode to the mode M3, the temperature detected by the environment sensor 10 began to decrease. Next, referring to FIG. 13(*b*), in the third embodiment, however, after the exhaust fan 17 was switched in operational mode to the mode M3 at the point r in time, the exhaust fan 17 was kept in the operational mode M3 for the preset length $t_{hold}$ of time regardless of the temperature detected by the environment sensor 10 until a point s in time.

At the point s in time, the CPU 50 returns to the step in which it selects an operational mode for the exhaust fan 17 based on the temperature detected by the environment sensor 10, and the operational mode M2 is selected again because of the decrease in the internal temperature of the housing. Thereafter, the exhaust fan 17 is kept in the mode. M2 for the present length $t_{hold}$ of time, and then, the CPU 50 selects an operational mode for the exhaust fan 17 based on the temperature detected by the environment sensor 10. Therefore, the interval with which the exhaust fan 17 is switched in operational mode is no less than the preset length $t_{hold}$ of time. Therefore, the unpleasant noises attributable to the exhaust fan 17 can be minimized.

<Flowchart of Embodiment 3>

Referring to FIG. 14 along with FIGS. 1 and 4, as the electric power source of the image forming apparatus 60 is turned on (S1400), the CPU 50 detects whether or not the rotational components of the developing apparatus 9Y, 9M, and 9C, and the rotational components of the developing apparatus 9K are rotating, through the encoders 53 and 52, respectively (S1401 and S1402). If the rotation is detected by the encoders 53 (Yes in S1401), the CPU 50 determines that the image forming apparatus 60 is in the full-color mode (S1403), whereas if the rotation is detected by only the encoder 52 (Yes in S1402), the CPU 50 determines that the image forming apparatus 60 is in the black-and-white mode (S1420).

If rotation is detected neither by encoder 53 nor 52 (No in S1402), the CPU 50 determines that the image forming apparatus 60 is in the standby mode (S1422), and selects the mode M0, which is lower in the number of revolution of the exhaust fan 17 than the operational mode M1 (S1423).

If the CPU 50 determines that the image forming apparatus 60 is in the full-color mode (S1403), it sets the timer to zero (t=0 (sec)) (S1404). Then, it samples the temperature detected by the environment sensor 10 (S1405), and estimates the temperature level Te of the developing apparatus 9M by computation based on the correlation described with reference to FIG. 6 (S1406). Then, it selects the operational mode based on the estimated temperature Te. That is:

(1) If the estimated (by computation) temperature level Te is less than (Te)1 (Ts<(Te) (Yes in S1407), the CPU 50 selects the operational mode M1, which is lowest in the number of the revolution of the exhaust fan 17 (S1410).

(2) If the estimated (by computation) temperature level Te is no less than (Te)1 and less than (Te)2 ((Te)1<Te<(Te)2) (Yes in S1408), the CPU 50 selects the operational mode M2 which is higher in the number of the revolution of the exhaust fan 17 than the operational mode M1 (S1411).

(3) If the estimated (by computation) temperature level Te is no less than (Te)2 (Te (Te)2) (Yes in S1409), the CPU 50 selects the operational mode M3 which is highest in the number of the revolution of the exhaust fan 17 (S1412).

Through the above-described steps, the cooling performance setting (amount of air volume) which is optimal for the rate of increase in the internal temperature of the housing of the image forming apparatus 60 is determined. If the operational mode selected through the above described steps is different from the preceding operational mode (Yes in S1414), the CPU 50 sets the timer to zero (t=0) (S1415). If the selected operational mode is not different from the preceding one (No in S1414), the CPU 50 does not reset the timer, and adds Δt (sampling interval) to the timer (S1416). Incidentally, in the first timer setting step (Yes in S1413), there is no history of the timer setting. Therefore, Δt is simply added (S1416).

Thereafter, the temperature Ts detected by the environment sensor 10 is not sampled until the value in the timer becomes greater than the preset length of the time $t_{hold}$ and the routine made up of the control steps S1417, S1418, and S1416 is repeated. Then:

(1) If the printing job in the full-color mode ends before the length of time $t_{hold}$ expires (No in S1417, and No in S1418), the CPU 50 proceeds to a control step S1419.

(2) If the printing job lasts longer than the preset length $t_{hold}$ of time, the CPU 50 starts sampling the temperature Ts detected by the environment sensor 10 (S1405) at a point in time at which the count t in the timer become greater than $t_{hold}$ (Yes in S1417). Then, the CPU 50 compares the temperature detected by the environment sensor 10 with the threshold level and selects the operational mode as described before.

On the other hand, it the CPU 50 determines that the image forming apparatus 60 is in the black-and-white mode (S1420), it proceeds to a control step S1500 of the flowchart in FIG. 15 (S1421). A control step S1501 and the steps thereafter are basically the same as the counterparts of the flowchart of the control sequence in the full-color mode, which were described with reference to FIG. 14, except that the temperature Te estimated by computation based on the temperature Te of the environment sensor 10 is for the belt cleaning apparatus 14.

<Embodiment 4>

The fourth embodiment also relates to the image forming apparatus 60 which was described with reference to FIGS. 1-6. Therefore, the descriptions given about the image forming apparatus 60 with reference to FIGS. 1-6 will not be repeated here. In the fourth embodiment, the CPU 50 determines whether to stop or start the exhaust fan 17 by comparing the temperature detected by the environment sensor 10 with a preset level (threshold level). Further, the threshold level is set so that its value for the black-and-white mode is lower than that for the full-color mode. A7

More specifically, in the fourth embodiment, the operational mode M1 which is one of the operational modes for the exhaust fan 17 in the first to third embodiment, is replaced with a mode in which the exhaust fan is not operated, and the operational mode M2 is replaced with a mode in which the exhaust fan is operated in a preset speed. That is, the operational mode M3 is not provided, and the exhaust fan 17 is operated in the mode in which it is kept stationary, or in the mode in which it is operated in the preset speed. Needless to say, the image forming apparatus 60 may be provided with multiple operational modes, that is, the above-mentioned mode in which the exhaust fan 17 is kept stationary, the mode in which the exhaust fan 17 is operated in the preset speed, and additional modes M3 (M4, M5 . . . Mn) which are different in the speed of the exhaust fan 17, to switch the exhaust fan 17 in the number of revolution in multiple steps. Further, the standby mode M0 provided in the first to third embodiments may be changed into the mode in which the exhaust fan 17 is not operated, from the standpoint of minimizing the image forming apparatus 60 in operational noise.

Also in the fourth embodiment, it is possible to set the threshold temperature levels so that the threshold temperature levels set to be used when the temperature Te detected by the environment sensor 10 increasing is different in value from those set to be used when the temperature Te detected by the environment sensor 10 is decreasing. In this case, the threshold levels for the temperature increase and decrease are for starting the exhaust fan 17.

<Effects of Embodiments>

In the first to fourth embodiments, even for an image forming apparatus (60) which has multiple components which need to be monitored in temperature, it is possible to set the least amount of air volume necessary for the exhaust fan 17 to properly cool the interior of the apparatus (60) in accordance with the properties of the apparatus (60) in terms of temperature increase in both the full-color mode and black-and-white mode. Further, the temperature of the multiple components of the apparatus (60) are estimated based on a single piece of information, that is, the temperature detected by the preexisting environment sensor 10 for controlling the processes carried out by the image forming portions of the apparatus (60). Therefore, it is unnecessary to equip the apparatus (60) with an additional environment sensor. In other words, these embodiments of the present invention can simplify color image forming apparatuses, such as the above-described one (60) in structure.

The second photosensitive member (8K) is positioned outside the area in which the multiple first photosensitive members (8Y, 8M, and 8C) are positioned. The temperature sensor (10) which is for detecting the internal ambient temperature of the housing of the image forming apparatus 60 is placed in the adjacencies of the first developing apparatus (9M) which is in the adjacencies of the first photosensitive member (8M), which is the middle one of the three first photosensitive members. Thus, the temperature sensor (10) is unlikely to be affected by the heat which comes from the direction of the second photosensitive member (8K), and therefore, it is possible to accurately estimate the internal temperature of the first developing apparatus (9M), which is likely to be increased in temperature by the heated air having become stagnant in the adjacencies of the first developing apparatus (9M).

In the first to fourth embodiments, the exhaust fan 17 was operated only when necessary to prevent the internal temperature of the housing of the image forming apparatus, based on the temperature of the multiple components which need to be monitored in temperature, which is estimated based on a singe piece of information, that is, the temperature detected by a single environment sensor. Therefore, the image forming apparatus (60) is prevented from excessively increasing in internal temperature while it is kept minimum in operational noises and electric power consumption. Thus, they are applicable to image forming apparatuses (printers, copy machines, facsimile machines, multifunction printers, etc.) of the electrophotographic type, inkjet type, and offset type, in particular, color image forming apparatuses which use multiple toners, different in color, and in which an exhaust fan (exhaust fans) is driven to cool the interior of the apparatus during an image forming operation.

Also in the first to fourth embodiment, two threshold levels (Te)1 and (Te)2 were provided to be compared with the estimated temperature of the components to be monitored in temperature. However, as long as the black-and-white mode is made lower than the full-color mode, threshold level (Te)1 for the estimated temperature, which is equivalent to the temperature (Ts)1, the threshold levels (Te)1 and (Te)2 may be the same, or different, in value.

In the first to third embodiments, the equation for approximating the temperature of the components to be monitored in temperature, which is shown in FIG. 6, was used to continuously and precisely observe the temperature of the components to be monitored in temperature, in order to control the exhaust fan 17. However, instead of using the above-mentioned equations, the exhaust fan 17 may be switched in operational mode as the temperatures (Ts)1 and (Ts)2 detected by the ambient air temperature reaches the threshold levels (Te')1 and (Te')2, respectively, although it is necessary that the black-and-white mode is made lower in the temperature (Ts)1 than the full-color mode.

Also in the first to third embodiments, in the standby mode, the operational mode M0, which is lower in the number of the revolution of the exhaust fan 17 than the operational mode M1, was selected. However, the mode M1 may be selected instead of the mode M0 as long as the operational modes M1, M2, and M3 are low enough in the number of the revolution of the exhaust fan 17 from the standpoint of reducing an image forming apparatus in operational noises.

Also in the first to third embodiments, the exhaust fan 17 is controlled in air volume (revolution) by the so-called PWM, in three steps in which the duty ratio was 40%, 75%, and 100%, one for one. However, the duty ratio is optional and so is the number of steps in which the exhaust fan 17 is controlled in air volume (revolution). The method for changing the exhaust fan 17 in the number of revolution does not need to be limited to the PWM. Further, the number of the operational modes for the exhaust fan 17 does not need to be limited to three, that is, modes M1, M2, and M3. For example, the image forming apparatus 60 may be designed so that the exhaust fan 17 is steplessly and continuously increased in revolution in response to the increase in the internal temperature of the housing of the apparatus 60.

According to the present invention, an image forming apparatus is designed so that the amount by which air is blown by the exhaust fan when the apparatus is in the second image formation mode in which the first developing apparatuses are not activated, and therefore, the temperature detected by the temperature sensor is lower than that in the first image formation mode, is made greater than that in the first image formation mode. Therefore, when the image forming apparatus is in the second image formation mode, it is higher in the performance for cooling the apparatus for cleaning the intermediary transfer member at a given temperature level detected by the temperature sensor than when it is in the first image formation mode. Therefore, the apparatus for cleaning the intermediary transfer member is prevented from excessively increasing in temperature even when the temperature detected by the temperature sensor is relatively low.

Therefore, it is possible to prevent the intermediary transfer member cleaning apparatus of an image forming apparatus from excessively increasing in temperature, while reducing the exhaust fan of the image forming apparatus in air volume to minimize the image forming apparatus in overall noise, when the image forming apparatus is in the black-and-while mode.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 179913/2009 filed Jul. 31, 2009 which is hereby incorporated by reference.

What is claimed is:

1. An image forming apparatus comprising:

a first developing device for developing a latent image formed on a first image bearing member into a toner image;

a second developing device for developing a latent image formed on a second image bearing member into a toner image;

a temperature sensor provided at a position closer to said second developing device than to said first developing device and capable of detecting an ambient temperature;

a controller capable of executing an operation in a first mode in which image formation is carried out only by said first developing device while said second developing device is at rest, and an operation in a second mode in which image formation is carried out using both of said first developing device and said second developing device; and an air feeding device for feeding air around said first developing device and said second developing device;

wherein said controller controls driving of said air feeding device on the basis of a detection result of said temperature sensor, and a temperature at which the driving of said air feeding device starts is lower in the first mode than in the second mode.

2. An apparatus according to claim 1, further comprising an intermediary transfer member onto which the toner images carried on said first image bearing member and said second image bearing member are transferred, and a spacing mechanism for spacing said second image bearing member from said intermediary transfer member in the first mode.

3. An apparatus according to claim 1, wherein a temperature at which said controller increases a feeding flow rate of said air feeding device from a first level to a second level is lower in the first mode than in the second mode.

4. An apparatus according to claim 1, wherein a temperature at which a drive amount of said air feeding device per unit time is increased to a predetermined drive amount is lower in the first mode than in the second mode.

5. An apparatus according to claim 1, further comprising an intermediary transfer member onto which the toner images carried on said first image bearing member and said second image bearing member are transferred, and a heating apparatus for heating a recording material having the toner image transferred from said intermediary transfer member, wherein said first developing device and said second developing device are disposed above said intermediary transfer member, and said second developing device is disposed upstream of said first developing device with respect to a rotational moving direction of said intermediary transfer member, and wherein said heating apparatus is disposed opposed to a lower surface of said intermediary transfer member at a disposition upstream of said second developing device with respect to a rotational moving direction of said intermediary transfer member and downstream of a transfer position for transferring the image from said intermediary transfer member onto a recording material.

6. An apparatus according to claim 5, further comprising a cleaning device for removing toner remaining on said intermediary transfer member, said cleaning device being provided downstream of said heating apparatus and upstream of said second developing device with respect to the rotational moving direction, wherein said air feeding device is capable of feeding air around said cleaning device.

7. An apparatus according to claim 5, wherein said heating apparatus is disposed at a position closer to said second developing device than to said first developing device.

8. An apparatus according to claim 1, wherein when the operation in the second mode is executed with a temperature of said first developing device being the same as a temperature of said second developing device, a temperature rising speed of said second developing device is higher than said first developing device.

9. An image forming apparatus comprising:

a first developing device for developing a latent image formed on a first image bearing member into a toner image;

a second developing device for developing a latent image formed on a second image bearing member into a toner image;

a temperature sensor provided at a position closer to said second developing device than to said first developing device and capable of detecting an ambient temperature;

a first controller capable of executing an operation in a first mode in which image formation is carried out only by said first developing device while said second developing device is at rest, and an operation in a second mode in which image formation is carried out using both of said first developing device and said second developing device;

an air feeding device for feeding air around said first developing device and said second developing device; and a second controller for controlling said air feeding device, wherein a temperature at which a drive amount of said air feeding device per unit time is increased to a predetermined drive amount is lower in the first mode than in the second mode.

10. An apparatus according to claim 9, further comprising an intermediary transfer member onto which the toner images carried on said first image bearing member and said second image bearing member are transferred, and a spacing mechanism for spacing said second image bearing member from said intermediary transfer member in the first mode.

* * * * *